US006175703B1

(12) United States Patent
Nakazono et al.

(10) Patent No.: US 6,175,703 B1
(45) Date of Patent: Jan. 16, 2001

(54) IMAGE FORMING APPARATUS AND PROCESS CARTRIDGE

(75) Inventors: Yusuke Nakazono, Toride; Junichi Kato, Kashiwa; Koichi Suwa, Kawasaki; Satoru Inami, Kashiwa; Masahiro Yoshida, Kashiwa; Atsutoshi Ando, Kashiwa; Satoshi Sunahara, Funabashi; Seiichi Shinohara, Abiko, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/425,734

(22) Filed: Oct. 22, 1999

(30) Foreign Application Priority Data

Oct. 23, 1998 (JP) ..... 10-302554

(51) Int. Cl.[7] ..... G03G 21/16; G03G 5/14; G03G 9/00; G03G 21/00

(52) U.S. Cl. ..... 399/111; 399/159; 399/343; 430/56; 430/107; 430/111

(58) Field of Search ..... 399/159, 343, 399/350, 357, 111; 430/32, 105, 107, 111, 58, 96, 56

(56) References Cited

U.S. PATENT DOCUMENTS 4,851,314 * 7/1989 Yoshihara ..... 430/58 X
5,038,174 8/1991 Kato et al. .
5,475,471 12/1995 Kisu et al. .
5,543,899 8/1996 Inami et al. .
5,765,077 6/1998 Sakurai et al. ..... 399/176
5,790,927 8/1998 Ando et al. ..... 399/176

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus having at least: an image carrying member for carrying an electrostatic latent image, the image carrying member having a photosensitive layer on a conductive substrate; a developer for developing the electrostatic latent image carrying member on the image carrying member; a developer carrying member for carrying the developer and conveying it to a development area; a control member making contact with the developer carrying member for controlling the coating amount of the developer; and a cleaning member for cleaning the surface of the photosensitive layer of the image carrying member by making contact with the surface of the image carrying member with a contact pressure of 0.15N (15 gf) to 0.89N (90 gf). The photosensitive layer contains at least one kind of polycarbonate resin (I) having a viscosity average molecular weight of $1.5\times10^4$ or less and at least one kind of polycarbonate resin (II) having a viscosity average molecular weight of more than $1.5\times10^4$, the polycarbonate resin (I) is contained in 30% by mass to 95% by mass based on the total content of the resins (I) and (II). The developer has a toner containing toner particles and external additives, and the toner contains (a) 0.1% by mass to 5.0% by mass of a first fine powder with a number average particle size of 0.005 $\mu$m to 3.00 $\mu$m, and (b) 0.02% by mass to 2.00% by mass of an inorganic second fine powder containing 25% by mass to 90% by mass of a lubricant, as external additives.

30 Claims, 3 Drawing Sheets

IMAGE FORMING APPARATUS AND PROCESS CARTRIDGE

BACKGROUND OF THE INVENTION

1. Field of the Invention

The present invention relates to an image forming apparatus such as the electrophotographic copier and electrophotographic printer, and a process cartridge.

2. Description of the Related Art

A toner is used as a powder developer in the electrophotographic image forming apparatus such as a laser beam printer and copier using an electrophotographic method.

The toner is housed in a developer container, conveyed to a toner carrying member with a toner transfer mechanism, and carried on the toner carrying member. The toner is then endowed with a prescribed amount of electrostatic charge with a blade functioning as a toner layer thickness control member, and moves to an electrostatic latent image forming member on the image carrying member for carrying the image, visualizing the latent image on the photosensitive member there. The visible image is then transferred to a transcription member, such as a sheet of paper, with a transcription mechanism, and fixed with a fixing machine. The toner remaining on the image carrying member without being transferred to the transcription member is peeled off from the surface of the image carrying member with a cleaning device making contact with the image carrying member and is conveyed to a cleaning vessel. A series of image forming processes is completed as described above, enabling the user to obtain a desired image.

One development method known in the art includes a jumping development method in which the latent image on the image carrying member is developed while holding the developer carrying member of the image forming apparatus without making contact with the image carrying member. A development machine adapting the jumping development method will be described hereinafter.

The toner housed in the developer container is held on a development sleeve functioning as a developer carrying member in the development machine taking advantage of the jumping method. The toner as a one-component developer carried on the development sleeve is conveyed to a development area facing the photosensitive member as an image carrying member by rotating the development sleeve. The toner is controlled with a blade making the contact with the development sleeve during its transfer and is coated on the development sleeve forming a thin layer. The development sleeve is held at a distance of 50 to 500 $\mu$m from the photosensitive member in the development area. The toner coated as a thin layer on the development sleeve jumps and adheres to the electrostatic latent image on the photosensitive member by applying a development bias voltage that is a superposition of direct current and alternating current from a bias power supply, thus visualizing the latent image as toner image.

The development bias voltage is also applied on a non-printing area such as the area between two sheets of paper.

However, it was difficult in the conventional development machine to obtain a desired image density because the amount of electrostatic charge given to the toner is so unstable that the increase in image density dulls the image at the initial stage when the image is continuously formed. Image defects are another problem under a high temperature and high humidity environment. Although these image defects may occur because of condensation on the surface of the photosensitive member, most of the image defects are caused by the following reasons. Talc contained in the transcription member adheres on the surface of the photosensitive member to allow oxides, formed by ozone generated from the electrostatic charging device, to react with moisture formed under a high humidity environment on the adhered talc, generating a product with ozone. Since this ozone product has low electrical resistance, the electrostatic charge in the charged potion on the image carrying member flows into the latent image portion to result in image defects. A decrease in durability due to the image defects was also an another problem.

Although image defects can be prevented from occurring when an abrasive is added in the toner to polish the surface of the image carrying member, irregular scrapes appear at minute portions on the image carrying member. When a part of the image carrying member has been deeply scraped, for example, the developer and additives accumulate there forming nuclei, where the toner damaged with the cleaning device may be sometimes fused.

Therefore, it was difficult in the conventional image forming apparatus to simultaneously solve all the problems of high resolution, fine image quality, durability and stability, image defects and fusion of the tone.

SUMMARY OF THE INVENTION

Accordingly, the object of the present invention is to provide an image forming apparatus and process cartridge for solving the foregoing problems.

Another object of the present invention is to provide an image forming apparatus and a process cartridge that is able to constantly form a high quality image while suppressing image defects, fusion of toners, and creep-out of additives.

Another object of the present invention is to provide an image forming apparatus and a process cartridge that is able to constantly form a high quality image while suppressing image defects, fusion of toners and crep-out of additives for improving image density.

Another object of the present invention is to provide an image forming apparatus and a process cartridge that is able to constantly form a high quality image while suppressing image defects, fusion of toners, and crep-out of additives for improving image density as well as adhesion of the toner caused on the photosensitive member and tailing of the toner occurring during development.

According to the present invention, there is provided an image carrying member for carrying an electrostatic latent image, said image carrying member having a photosensitive layer on a conductive substrate;

a developer for developing the electrostatic latent image carried on the image carrying member;

a developer carrying member for carrying the developer and conveying it to a development area;

a control member making contact with the developer carrying member for controlling the coating amount of the developer; and a cleaning member for cleaning the surface of the photosensitive layer of said image carrying member by making contact with the surface of the photosensitive layer of the image carrying member with a contact pressure of 0.15N (15 gf) to 0.89N (90 gf), wherein the photosensitive layer contains at least one kind of polycarbonate resin (I) having a viscosity average molecular weight of $1.5\times10^4$ or less and at least one kind of polycarbonate resin (II) having a viscosity average molecular weight of more than $1.5\times10^4$, the polycarbonate resin (I) is contained in 30% by mass to 95% by mass based on the total content of the resins (I) and (II), wherein the developer has a toner containing toner particles and external additives, and wherein the toner contains (a) 0.1% by mass to 5.0% by mass of a first fine powder with a number average particle size of 0.005 μm to 3.00 μm, and (b) 0.02% by mass to 2.00% by mass of an inorganic second fine powder containing 25% by mass to 90% by mass of a lubricant, as external additives.

According to the present invention, there is also provided a process cartridge detachably mountable to a main unit of an image forming apparatus, comprising:

an image carrying member for carrying an electrostatic latent image, said image carrying member having a photosensitive layer on a conductive substrate;

a developer for developing the electrostatic latent image carried on the image carrying member;

a developer carrying member for carrying the developer to convey it to a development area;

a controlling member for controlling the coating amount of the developer by making contact with the developer carrying member;

a cleaning member for cleaning the surface of the photosensitive layer of said image carrying member by making contact with the surface of the photosensitive member of the image carrying member with a contact pressure 0.15N (15 fg) to 0.89N (90 gf); and a cartridge container for integrating the image carrying member, the developer, the developer carrying member, the control member and the cleaning member into one unit, wherein the photosensitive layer contains at least one kind of polycarbonate resin (I) having a viscosity average molecular weight of $1.5\times10^4$ or less and at least one kind of polycarbonate resin (II) having a viscosity average molecular weight of more than $1.5\times10^4$, the polycarbonate resin (I) accounting for 30% by mass to 95% by mass based on the total content of the resins (I) and (II), wherein the developer has a toner containing toner particles and external additives, and wherein the toner contains (a) 0.1% by mass to 5.0% by mass of a first fine powder with a number average particle size of 0.005 μm to 3.00 μm, and (b) 0.02% by mass to 2.00% by mass of an inorganic second fine powder containing 25% by mass to 90% by mass of a lubricant, as external additives.

DESCRIPTION OF THE PREFERRED EMBODIMENT

Figure 1:
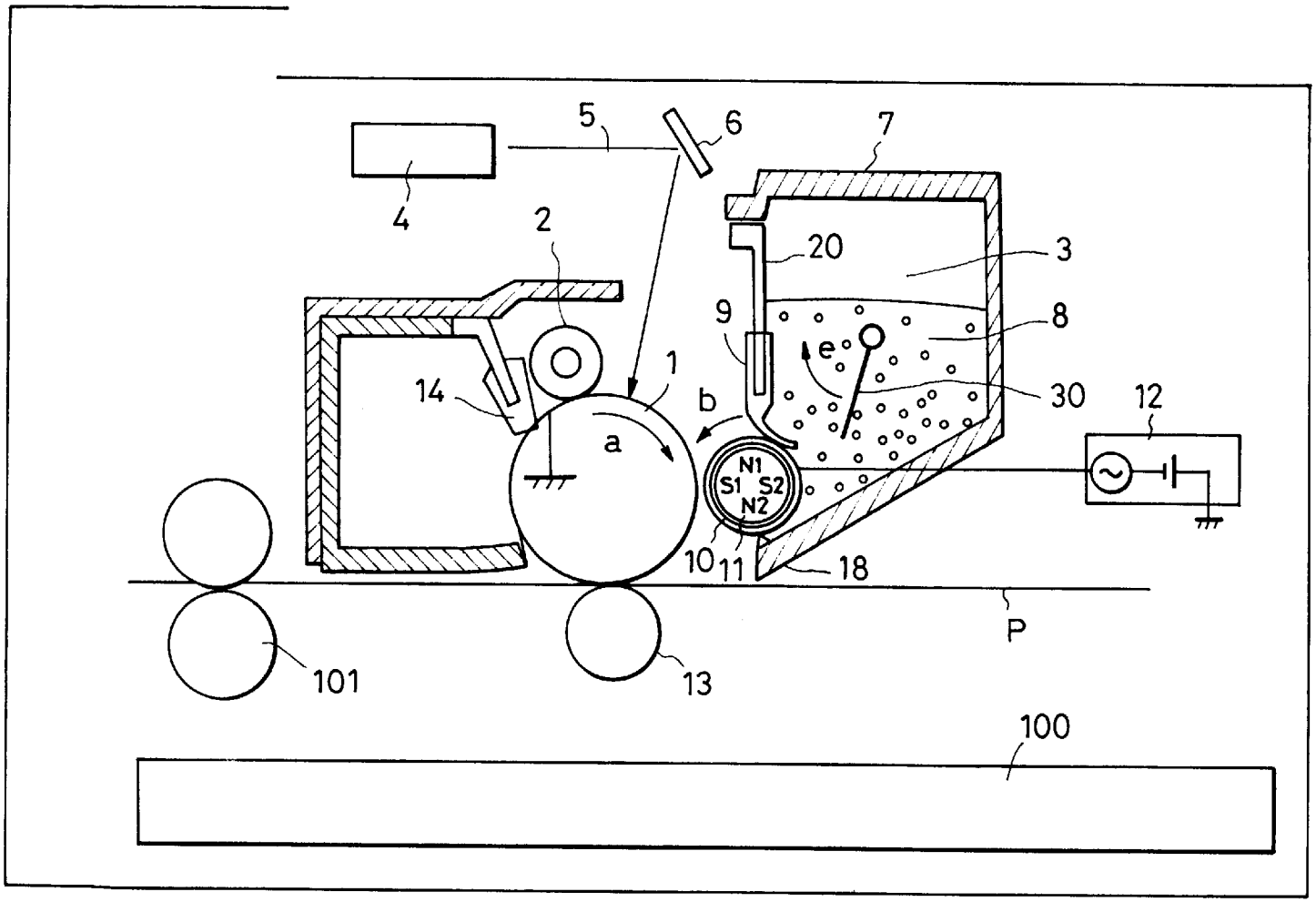
FIG. 1 shows a cross section of an illustrative construction of the image forming apparatus according to the present invention.

An object of the present invention is to provide an image forming apparatus that can suppress image defects and the fusion of the toner as hitherto described while producing an image with high resolution, fine image quality, and excellent durability and stability. It was found that this object can be attained by combining an image carrying member (i) having a photosensitive surface layer containing a polycarbonate resin (I) having a specified viscosity average molecular weight and a polycarbonate resin (II) having a specified viscosity average molecular weight in a specified composition ratio, with a toner (ii) having an additive containing a first fine powder having a specified number average particle size, and a second inorganic fine powder containing a specified amount of a lubricant in specified amounts.

The image carrying member (i), in which the surface of the photosensitive layer contains at least one of the polycarbonate resins (I) having a viscosity average molecular weight of $1.5\times10^4$ or less, and at least one of the polycarbonate resins (II) having a viscosity average molecular weight of more than $1.5\times10^4$ in a ratio of 30% by mass to 95% by mass based on the total content of the polycarbonate resins (I) and (II), is used in the image forming apparatus according to the present invention. When the surface of the photosensitive layer is cleaned by allowing it to make contact with the cleaning member with a specified contact pressure, the photosensitive layer is endowed with an appropriate wearing property, thereby enabling image defects, due to adhesion of ozone compounds, to be suppressed and allowing fine irregular scrapes that deeply scratch the surface of the photosensitive layer to be readily generated. The developer has the toner containing toner particles and external additives. The toner containing (a) 0.1% by mass to 5.0% by mass of the first fine powder with a number average particle size of 0.005 μm to 3.00 μm and (b) 0.02% by mass to 2.00% by mass of the second inorganic fine powder containing 25% by mass to 90% by mass of the lubricant, as the external additive, is also used in the image forming apparatus according to the present invention. The first fine powder allows the surface layer of the specified photosensitive layer in the image carrying member (i) to be uniformly scraped during wearing, thereby preventing the layer from being unevenly scraped. Even when fine irregular scrapes appear on the surface of the specified photosensitive layer in the image carrying member (i), the lubricant contained in the second inorganic fine powder is expanded and buried into the portion of uneven scratches by cleaning the surface of the photosensitive layer by contacting the cleaning member to the surface with a specified contact pressure. Accordingly, the toner component is never accumulated on the surface of the photosensitive layer to exclude generation of nuclei that cause fusion of the toner on the surface of the photosensitive layer. The combination of the image carrying member (i) and toner (ii) as described above consequently allows image defects and fusion of the toner to be suppressed, and an image with a high resolution and fine quality to be formed, thereby making it possible to form a good image being excellent in durability and stability.

Examples of the first fine powder to be used in the present invention comprises (i) fine powder of a resin, (ii) fine powder of silica, alumina or titanium oxide, and (iii) fine powder of strontium titanate, cerium titanate or magnesium titanate.

(i) When the first fine powder contains 0.1% by mass to 5.0% by mass of the resin fine powder with a number average particle size of 0.005 μm to 3.00 μm in the first embodiment, image defects and fusion of the toner can be suppressed to constantly form a high quality image while improving image density.

(ii) When the first fine powder contains 0.1% by mass to 5.0% by mass, preferably 0.8% by mass to 2.0% by mass, of a fine powder of silica, alumina or titanium oxide with a number average particle size of 0.005 μm to 2.50 μm in the second embodiment, image defects and fusion of the toner can be also suppressed to constantly form a high quality image while improving image density.

(iii) When the first fine powder contains 0.1% by mass to 5.0% by mass, preferably 0.1% by mass to 4.0% by mass, of a fine powder of strontium titanate, cerium titanate or magnesium titanate with a number average particle size of 0.01 μm to 3.00 μm in the third embodiment, image defects and fusion of the toner can be also suppressed to constantly form a high quality image while suppressing adhesion of the toner occurring on the photosensitive member (termed as "filming" hereinafter) or tailing of the toner appearing during fixing.

The values of the "viscosity average molecular weight" and "number average particle size" according to the present invention are determined by the following measuring methods, which are used in the following examples.

Measurement of Viscosity Average Molecular Weight of Polycarbonate Resin

Dissolved in 100 ml of methylene chloride is precisely weighed 0.5 g of the sample, and the specific viscosity of this solution is measured at 25° C. using a Uberhode type viscometer. The limiting viscosity number (intrinsic viscosity) is determined using the specific viscosity, and the viscosity average molecular weight is calculated from the Mark-Houwink's viscosity equation.

Measurement of Number Average Particle Size of First Fine Powder and Second Inorganic Fine Powder The first fine powder and the second inorganic fine powder were photographed under an electron microscope S-4700 (made by Hitachi Seisakusho Co., Ltd.) with 100,000 and 100 to 10,000 times of magnification, respectively. One hundred to two hundreds particles having a particle size of 0.001 μm or more, and a particle size of 0.1 μm or more, were randomly extracted from the first fine particles and second inorganic fine particles, respectively. Diameters of individual particles were measured using a measuring tool such as a vernier caliper, and an averaged particle size of each kind of the particles was defined to be a number average particle size of the fine powder. When the diameter of a particle photographed under the electron microscope is so small that its diameter can not be determined, the photograph may be enlarged to a measurable magnification scale to determine the diameter of the particle.

First Embodiment

The first embodiment according to the present invention will be described hereinafter with reference to the attached drawing.

FIG. 1 shows a cross section of an illustrative construction of the image forming apparatus according to the present invention.

A photosensitive member 1, an electrostatic charging roller 2, a development machine 7, a cleaning device 14, a transcription roller 13, a laser scanner 4 functioning as an optical system, a mirror 6 and a cassette 100 for mounting a transcription member are disposed in this image forming apparatus.

The image forming apparatus is provided with the photosensitive member 1 as a charging subject (an image carrying member). The photosensitive member 1 is constructed by laminating a photoconductive photosensitive layer on the surface of a conductive substrate made of aluminum, which is rotated along the direction indicated by an arrow a.

The photosensitive member 1 receives a negatively charged uniform charge from the rotating electrostatic charging roller 2. A laser light 5 corresponding to time-series electric digital signals sent from a video-controller (not shown) is then emitted from the laser scanner 4. An electrostatic latent image is formed on the surface of the photosensitive layer by the laser light via the mirror 6 mounted in the main unit of the image forming apparatus.

The electrostatic latent image on the photosensitive member 1 is inversely developed to form a positive image with the toner 8 retained on the development sleeve 10 in the development machine 7.

The toner image described above is electrostatically transferred onto the transcription member P by the function of transcription bias impressed on the transcription roller 13. The transcription member P receiving the transferred toner image is separated from the photosensitive member 1 and conveyed into the development machine 101. After fixing the toner image, the transcription member P is discharged out of the main unit of the image forming apparatus.

The remaining toner on the photosensitive member 1 after transcription of the image is removed by the cleaning device 14 to the photosensitive member for the succeeding image forming process.

The electrostatic charging roller 2 is composed of a core metal and medium resistance elastic rubber coated on the circumference of the metal forming the roller. Both ends of the core metal are supported with bearings to be freely rotatable and so that the electrostatic charging roller 2 always makes contact with the photosensitive member 1. The electrostatic charging roller 2 is allowed to rotate depending on the rotation of the photosensitive member 1.

The core metal of the charging roller 2 is electrically connected to a charging bias applying power supply that can provide a superposition of a DC bias and AC bias. The surface of the photosensitive member 1 is electrostatically charged at a prescribed electric potential by applying a bias to the electrostatic charging roller 2 via the core metal.

A non-contact method is used in the development machine 7, which contains the development sleeve 10 as a toner carrying member for carrying the toner to be transferred to the photosensitive member 1 and a developer container 3.

A agitating member 30, rotating along the direction e, for agitating the toner 8 and feeding the toner toward the development sleeve 10 is provided in the developer container 3.

The development sleeve 10 is composed of a non-magnetic biscuit tube on which paint of dispersed carbon is coated. The biscuit tube is made of such material as aluminum or stainless steel. The surface of the development sleeve 10 becomes rough by coating the paint, which contribute to conveying the toner on the development sleeve 10.

In addition, the development sleeve 10 is supported to be freely rotatable with the bearings (not shown), and is rotated relative to the photosensitive member 1 via a gear (not shown) along the direction indicated by an arrow b. The development sleeve 10 is connected to a power supply 12 that can supply a bias voltage of a superposition of DC bias and AC bias. The latent image on the photosensitive member 1 is converted into a visible toner image by impressing a bias voltage from the power supply 12. The development sleeve 10 is held to face to the photosensitive member 1 with a given distance for development.

The doctor blade 9 functioning as a toner layer thickness control member for controlling the coating amount and layer thickness of the toner 8 on the development sleeve, can endow the layer with a proper tribo-electrification by frictional charging. The controlled thickness of the toner layer formed on the development sleeve is adjusted to be equal to the minimum gap between the photosensitive member and development sleeve. The toner 8 is a negative toner that serves as a magnetic one-component developer. The doctor blade 9 is made of a polyurethane rubber. A metal plate 20 is fixed on the inner wall of the development machine 7.

A magnet roller 11 having four magnetic poles is disposed by being fixed in the development sleeve 10. The S1 pole of the four magnetic poles is disposed in confronting relation to the photosensitive member 1. The S1 pole is necessary for allowing the toner that causes fogging to be adhered on the sleeve 10. The S2 pole, which serves to allow the toner in the developer container 3 to adhere on the sleeve 10 to circulate the toner 8 in the vicinity of the sleeve 10 with rotation of the sleeve 10, is disposed opposite to the S1 pole. This circulation serves for endowing the toner 8 with tribological properties. Both of the N1 and N2 poles are used for conveying the toner 8 coated on the development sleeve 10 and are used for endowing the toner with tribological properties. Although a four-poles type magnet roller was used in the present embodiment, the number of the poles may not be necessarily limited to four provided the poles have the functions as described above.

Meanwhile, a toner-blow preventive sheet 18 is attached inside of the developer container 3 beneath the development sleeve 10 for preventing the toner from leaking from under the development sleeve.

The service life of the photosensitive member 1 is 10,000 sheets when characters are printed with a mean dot ratio of 4% per one page.

The photosensitive member and the toner according to the present invention will be described in detail hereinafter.

The surface layer of the photosensitive member 1 contains at least one kind of a polycarbonate resin (I) having a viscosity average molecular weight of $1.5\times10^4$ or less and at least one kind of a polycarbonate resin (II) having a viscosity average molecular weight of more than $1.5\times10^4$ in the present embodiment, wherein a photosensitive member that contains 25% to 95% by mass of the polycarbonate resin (I) based on the combined amount of the polycarbonate resin (I) and polycarbonate resin (II) is used. A toner, containing a melamine-formaldehyde condensate fine powder as the first fine powder and an inorganic fine powder as the second fine powder in which silicone oil is blended in a high proportion in a specified proportion, is used as the toner 8 to be used in the present invention.

The second inorganic fine powder comprises oxides such as $SiO_2$, $Geo_2$, $TiO_2$, $SnO_2$, $Al_2O_3$, $B_2O_3$, $P_2O_5$ and $AS_2O_3$; metallic oxide acid salts such as silicic acid salts, boric acid salts, phosphoric acid salts, germanic acid salts, alumino-silisic acid salts, aluminosilicic acid salts, aluminoboric acid salts, alumino-borosilicic acid salts, tungstic acid salts, molybdic acid salts and telluric acid salts; and a composite compounds thereof; and pure silicon carbide, silicon nitride, and amorphous carbon, or a mixture thereof. While metal oxides are widely used among them, oxides of Si, Al and Ti, and a composite compound thereof are more preferable.

The second inorganic fine powder according to the present embodiment has a number average particle size of 8 $\mu$m, and contains 40% by mass of silicone oil as a lubricant, which is dimethyl silicone oil with a viscosity of 12,500 cSt.

The surface of the photosensitive member 1 has an appropriate wearing property due to a specified composition as described above, while adding a fine powder of a melamine-formaldehyde condensate. Consequently, the ozone compounds formed on the photosensitive member can be removed by uniformly scraping the surface layer of the photosensitive member to wear it, enabling image defects to be prevented. Since the surface layer of the photosensitive member 1 has an appropriate wearing property, fine irregular scrapes that deeply scratch the surface of the photosensitive member are increased to readily make the surface of the photosensitive member rough, as compared with a photosensitive member with a small degree of wearing property by allowing the surface layer to contain only the polycarbonate resin (I). However, when the inorganic fine powder containing a lubricant in the toner is added as the second inorganic fine powder, silicone oil in the inorganic fine powder expands due to the cleaning device 14 that makes a contact with the surface of the photosensitive member or with the electrostatic charging roller 2 to fill up the irregular scratches, even when fine irregular scrapes that deeply scratch the surface of the photosensitive member 1 appear. Therefore, the toner and additive never accumulate on the photosensitive member 1, and no nuclei that trigger fusion of the toner is found on the photosensitive member 1, consequently preventing fusion of the toner.

The contact pressure of the cleaning device 14 to the surface of the photosensitive member 1 may be 0.15N (15 gf) to 0.89N (90 gf), preferably 0.20N (20 gf) to 0.69N (70 gf), when a cleaning blade is used for the cleaning device 14. It is desirable that the electrostatic charging roller preferably makes contact to the surface of the photosensitive member with a contact pressure of 1.96N (200 gf) to 29.42N (3,000 gf), and more preferably 2.94N (300 gf) to 19.61N (2,000 gf).

When the contact pressure of the cleaning blade to the surface of the photosensitive member is less than 0.15N (15 gf), the toner may creep out and the cleaning effect may be poor while, when the contact pressure exceeds 0.89N (90 gf), the photosensitive member is so largely scraped that the service life of the photosensitive layer on the photosensitive member is shortened. When the contact pressure of the charging roller to the photosensitive member is less than 1.96N (200 gf), on the other hand, the nip angle between the photosensitive member may be inappropriate to cause mal-electrification while, when the pressure exceeds 29.42N (3,000 gf), the electrostatic charging roller is readily deformed (permanent deformation) at the contact area with the photosensitive member.

The contact pressure of the cleaning blade with the photosensitive member 1 is set to 0.29N (30 gf), while the contact pressure of the charging roller with the photosensitive member is set to 9.81N (1,000 gf) in the present embodiment.

Figure 2:
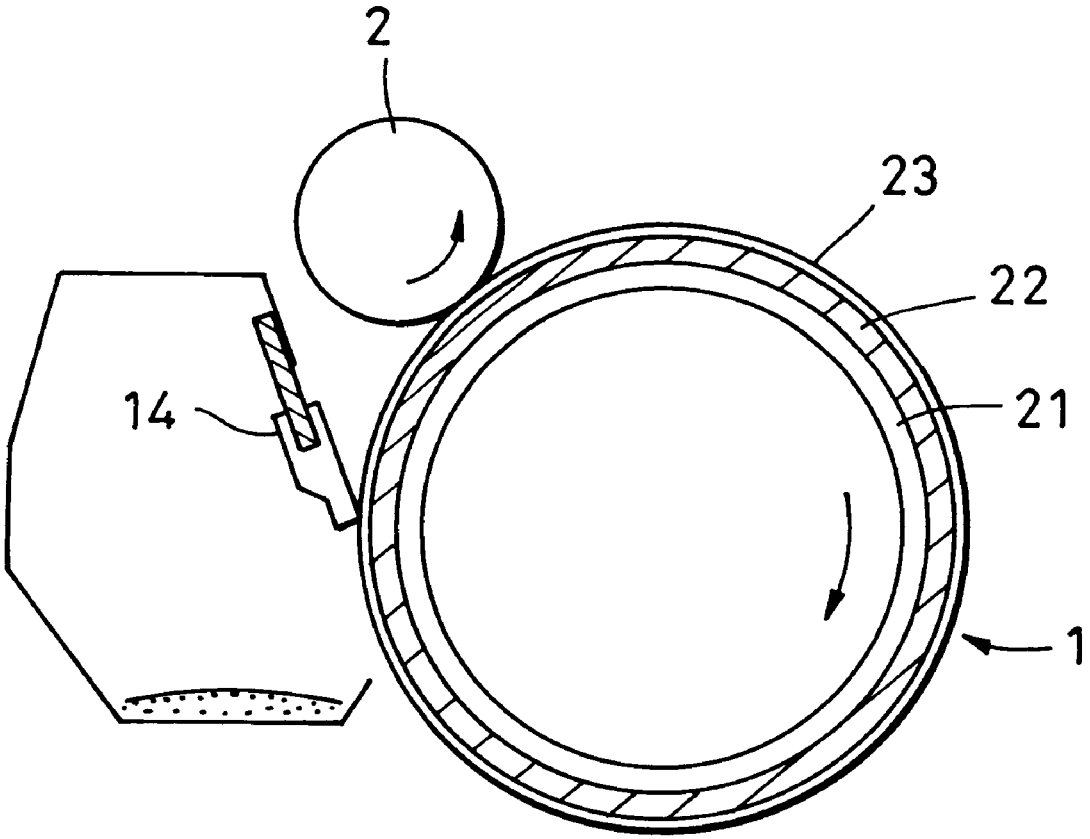
FIG. 2 shows a cross section in the periphery of the photosensitive member of the image forming apparatus according to the present invention.

FIG. 2 shows a part of the photosensitive member 1 to be used in the present embodiment in detail.

The photosensitive member 1 comprises a substrate 21, a charge generating layer 22 and a charge transfer layer 23. A cylinder or a film made of a metal such as aluminum or stainless steel, paper or plastic is used for the substrate 21. An aluminum cylinder with a diameter of 30 mm was used in the present embodiment.

The charge generating layer 22 is formed by coating a slurry prepared by thoroughly dispersing a charge generating pigment with 0.5 to 4-fold of a bonding resin and solvent using a homogenizer, an ultrasonic disperser, a ball mill, a vibrating ball mill, a sand mill, an atomizer and a roll mill, followed by drying. The thickness of the layer is about 0.1 to 1 $\mu$m.

The charge transfer layer 23 is formed by coating a solution of a blended composition of a charge transfer substance with the polycarbonate resins (I) and (II) dissolved in a solvent on the charge generating layer. The bending ratio between the charge transfer substance and the blended composition of the polycarbonate resins is about 2:1 to 1:2. Ketones such as cyclohexanone, esters such as methyl acetate and ethyl acetate, ethers such as THF, and chlorinated hydrocarbons such as chlorobenzene, chloroform and carbon tetrachloride are used for the solvent.

The charge transfer layer 23 comprises the charge transfer substance and a composition of a polycarbonate resin with a viscosity average molecular weight of $5\times10^3$ and a polycarbonate resin with a viscosity average molecular weight of $5\times10^4$, in which 40% by mass of the polycarbonate resin with a viscosity average molecular weight of $5\times10^3$ is contained based on the total amount of the polycarbonate resin, in the present embodiment.

Although the strength (abrasion resistance and hardness) of the resin in general increases as the molecular weight is increased, the strength does not increase any more when the molecular weight exceeds a limit, indicating a constant level. When the molecular weight is decreased, on the other hand, the strength is gradually reduced to show a rapid decrease at a given molecular weight or lower.

Since the viscosity average molecular weight of the polycarbonate resin when the strength rapidly decreases is in the range of $1.5\times10^4$ to $2.0\times10^4$, the photosensitive layer can be endowed with an appropriate wearing property when a resin having a lower molecular weight than described above is allowed to contain in a given quantity.

The photosensitive layer containing such polycarbonate resins as described above have an appropriate wearing property. Therefore, low resistive adhesion substances such as ozone compounds are readily removed by virtue of the minutely worn surface of the photosensitive layer, hardly causing deteriorated image quality since the surface is kept clean. However, the surface not containing the low molecular weight components tend to be susceptible to mechanical stresses such as scrubbing, generating portions which are largely worn and a little worn when images are repeatedly formed. Consequently, the low resistive adhesion substances may be incompletely removed to cause somewhat disadvantageous results for prevention of image defects.

It is preferable that the blended composition of the polycarbonates (I) and (II) contains 30% by mass to 95% by mass of the polycarbonate (I) with a viscosity average molecular weight of more than $1.5\times10^4$ in the present invention.

When the content of the polycarbonate (I) is less than 30% by mass, the photosensitive layer can not be endowed with an appropriate wearing property filing to exhibit the effects as described above. When the content of the polycarbonate (I) exceeds 95% by mass, on the other hand, the photosensitive layer is too largely worn or the viscosity of the resin solution is decreased. It is advantageous that the viscosity average molecular weight of the polycarbonate (I) is $1.5\times10^4$ or less where an abrupt decrease of strength is caused.

The polycarbonate resin to be used in the present invention contains a linear polymer having one kind or plural kinds of the components represented by the general formula (A) below: General formula (A)

(A)

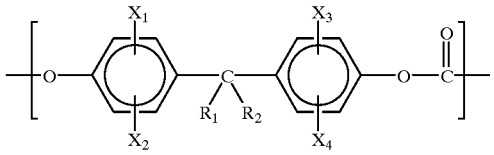

(Each of $R_1$ and $R_2$ in the formula denotes hydrogen, alkyl or aromatic groups, wherein a cyclic structure bonded with $R_1$ and $R_2$ may be constructed. Each of X1, X2, X3 and X4 represents a hydrogen atom, a halogen atom, an alkyl group or an aryl group.)

Examples of the charge transfer substance comprises a triarylamine compound, a hydrazone compound, a stilbene compound, a pyrazoline compound, an oxazole compound, a triallyl methane compound and a chiazole compound.

The toner 8 used in the present embodiment will be described hereinafter in detail.

The toner 8 contains toner particles having a desired particle size distribution prepared by the steps of: melting and kneading a mixture of a bonding resin, magnetic substance, charge control agent and wax with a biaxial extruder heated at 130° C., coarsely crushing the cooled mixture, finely pulverizing the coarse crushed particles with a jet-mill, and sieving the particles with an elbow classifier. A fine powder of a melamine-formaldehyde condensate with a number average particle size of 0.3 $\mu$m as the first fine powder, and an inorganic fine powder with a number average particle size of 8 $\mu$m as the second inorganic fine powder, prepared by adding 40% by mass of silicone oil in $SiO_2$(referred as "inorganic fine powder A hereinafter), were further externally added to the toner powder in a specified mixing ratio in the present embodiment using a Henshel mixer.

Using the composition described above in combination with the photosensitive member 1 allows the surface of the photosensitive member 1 to be uniformly worn to prevent image defects. Moreover, minute irregular scrapes of the photosensitive member 1 that deeply scratch the surface of the photosensitive member 1 can be prevented to consequently exclude fusion of the toner, enabling a high quality image to be obtained.

A continuous durability test was carried out using the photosensitive member 1 and toner 8 having the constructions as described above in a high temperature/high humidity environment (referred as "H/H environment" hereinafter) of 32.5° C. and 80% RH with an image printing ratio of 4%, in order to evaluate the degree of image defects. The degree of image defects was also evaluated in a comparative experiment using a photosensitive member 1 solely containing a polycarbonate resin with a viscosity average molecular weight of $2\times10^4$ in the charge transfer layer 23. The continuous durability test was also carried out in a low temperature/low humidity environment (referred as "L/L environment" hereafter) of 15° C. and 10% RH with an image printing ratio of 4%, wherein creep-out of melamine-formaldehyde resin at the cleaning device was evaluated.

Zero to 5.5% by mass of the melamine-formaldehyde condensate and 0.02 to 2% by mass of the inorganic fine powder A were externally added to the toner 8 in the experiments.

The number average particle size of the primary particles of the melamine-formaldehyde condensate fine powder to be externally added was 0.3 μm when the externally adding amount of the melamine-formaldehyde condensate fine powder was zero to 5.5% by mass.

The number average particle size of the primary particles of the melamine-formaldehyde condensate fine powder was changed to 0.002 μm, 0.005 μm, 3 μm and 3.5 μm when the amount of external addition of the melamine-formaldehyde condensate fine powder was either 0.1% by mass or 5% by mass, and the amount of external addition of the inorganic fine powder A was 2.0% by mass, in order to confirm the degree of image defects and creep-out of the melamine-formaldehyde condensate fine powder in the cleaning device (referred as "creep-out" hereinafter).

The amount of external addition of the inorganic fine powder A was changed in the range of zero to 2.01% by mass when the amount of external addition of the melamine-formaldehyde condensate fine powder was either 0.1% by mass or 5% by mass for the continuous durability test in the H/H environment with an image printing ratio of 4%, thereby evaluating the degree of image defects and fusion of the toner.

The experimental conditions listed in TABLE 1 are described in detail.

resin (II). The amount of external addition of the inorganic fine powder A in the toner is 2.0% by mass.

(3) The polycarbonate resin (I) and polycarbonate resin (II) are blended in the surface layer of the photosensitive member. The amount of external addition of the inorganic fine powder A in the toner is 0.02% by mass.

(4) The polycarbonate resin (I) and polycarbonate resin (II) are blended in the surface layer of the photosensitive member. The amount of external addition of the inorganic fine powder A in the toner is 2.0% by mass.

(5) The polycarbonate resin (I) and polycarbonate resin (II) are blended in the surface layer of the photosensitive member. The amount of external addition of the inorganic fine powder A in the toner is 0.02% by mass.

(6) The polycarbonate resin (I) and polycarbonate resin (II) are blended in the surface layer of the photosensitive member. The amount of external addition of the inorganic fine powder A in the toner is 2.0% by mass.

TABLE 1

The relation between the amount of external addition of the melamine-formaldehyde condensate, and image defects and creep-out

| | PHOTOSENSITIVE MEMBER* | MELAMINE-FORMALDEHYDE CONDENSATE (% BY MASS) → INORGANIC FINE POWDER A (% BY MASS) ↓ | 0 | 0.1 | 0.5 | 1.0 | 2.0 | 3.0 | 3.5 | 4.0 | 5.0 | 5.5 |
|---|---|---|---|---|---|---|---|---|---|---|---|---|
| (1) IMAGE DEFECTS IN COMPARATIVE EXPERIMENT | PHOTOSENSITIVE MATERIAL (A) | 0.02 | C | C | C | C | C | C | C | C | C | C |
| (2) IMAGE DEFECTS IN COMPARATIVE EXPERIMENT | PHOTOSENSITIVE MATERIAL (A) | 2.0 | C | C | C | C | C | C | C | C | C | C |
| (3) IMAGE DEFECTS | PHOTOSENSITIVE MATERIAL (B) | 0.02 | C | A | A | A | A | A | A | A | A | A |
| (4) IMAGE DEFECTS | PHOTOSENSITIVE MATERIAL (B) | 2.0 | C | B | A | A | A | A | A | A | A | A |
| (5) CREEP-OUT | PHOTOSENSITIVE MATERIAL (B) | 0.02 | A | A | A | A | A | A | A | A | B | C |
| (6) CREEP-OUT | PHOTOSENSITIVE MATERIAL (B) | 2.0 | A | A | A | A | A | A | A | A | B | C |

*Photosensitive material (A): The surface layer is formed with a composition containing 100% by mass of the polycarbonate resin (II) with a viscosity average molecular weight of $2 \times 10^4$.
Photosensitive material (B): The surface layer is formed with a composition containing 40% by mass of the polycarbonate resin (I) with a viscosity average molecular weight of $5 \times 10^3$ and 60% by mass of the polycarbonate resin (II) with a viscosity average molecular weight of $1 \times 10^4$.

TABLE 1 denotes the test results for confirming the degree of image defects and "creep-out", carried out by changing the adding amount of the melamine-formaldehyde condensate fine powder (primary particles as the first fine powder) with a number average particle size of 0.3 μm in the range of zero to 5.5% by mass. Image defects in the continuous durability test under the H/H environment (image printing ratio of 4%) were confirmed in the experiments (1) to (4), while "creep-out" in the continuous durability test under the L/L environment (image printing ratio of 4%) was confirmed in the experiments (5) and (6).

(1) Comparative experiment: The surface layer of the photosensitive member merely contains the polycarbonate resin (II). The amount of external addition of the inorganic fine powder A in the toner is 0.02% by mass.

(2) Comparative experiment: The surface layer of the photosensitive member merely contains the polycarbonate TABLE 1 shows the results of 10,000 sheets of continuous durability tests. The letter A, B and C in the table denotes the results of a good level, a normal level and a poor level, respectively.

TABLE 1 shows that image defects are not observed at all indicating a good level in the experiment (3) in which 0.02% by mass of the inorganic fine powder A is externally added while externally adding 0.1 to 5.5% by mass of the melamine-formaldehyde condensate fine powder. This is because the photosensitive member 1 is uniformly worn since the melamine-formaldehyde condensate fine powder externally added to the toner is transferred to the photosensitive member 1, thereby locally leaving no low resistive adhesion substances to enable image defects to be avoided. Since a small amount of the inorganic fine powder A is externally added, a small amount of the lubricant is expanded on the photosensitive member 1, thus allowing the low resistive substances to be removed to cause no image defects at all.

Image defects appear at 3,346 sheets of printing in the continuous durability test in the experiment (4) when the amount of external addition of the melamine-formaldehyde condensate is zero % by mass, showing a poor level. This is because, since no melamine-formaldehyde condensate fine powder for polishing the photosensitive member is added to the toner, low resistive substances generated on the photosensitive member 1 can not be removed to cause image defects.

When the inorganic fine powder A is externally added in the proportion of 2.0% by mass while externally adding 0.5 to 5.5% by mass of the melamine-formaldehyde condensate fine powder in experiment (4), the result shows a good level without causing any image defects, because the photosensitive member 1 is uniformly worn by the melamine-formaldehyde condensate fine powder transferred to the surface of the photosensitive member 1, locally leaving no low resistive adhesion substances and causing no image defects.

Slight image defects are observed at 9,356 sheets in the continuous durability test when 0.1% by mass of the melamine-formaldehyde condensate fine powder is externally added, showing a normal level of the result. This is because the amount of the lubricant expanded on the photosensitive member 1 is somewhat increased since 2.0% by mass of the inorganic fine powder A is externally added, thereby locally leaving the low resistive substances on the photosensitive member 1.

Image defects were caused at 3,203 sheets in the continuous durability test when zero % by mass of the melamine-formaldehyde condensate fine powder is externally added in the experiment (4), because portions with large wear and small wear are generated by repeatedly forming images, consequently causing image defects, since the low resistive adhesion substances remain at the portion where a small proportion of the surface has been worn.

When only the polycarbonate resin with a viscosity average molecular weight of $2\times10^4$ is used in the photosensitive member in the comparative experiments (1) and (2), on the other hand, image defects appear at 500 sheets or less in the continuous durability test even if the melamine-formaldehyde fine powder is externally added in any quantity in the range of zero to 5.5% by mass, causing a poor level of experimental results. This is because the surface of the photosensitive member is not worn even when the amount of external addition of the melamine-formaldehyde condensate fine powder is increased, since the surface of the photosensitive member has no wearing property, resulting in image defects. Image defects were independent of the amount of external addition of the inorganic fine powder A in this case.

The experimental evidence as hitherto described suggests that image defects can be prevented when the surface of the photosensitive member has an appropriate wearing property and the toner contains an appropriate amount of external additives, thereby enabling the photosensitive member 1 to be uniformly scraped.

"Creep-out" does not appear at all in the experiments (5) and (6) in which zero to 4.0% by mass of the melamine-formaldehyde condensate fine powder is externally added, giving a good level of the experimental results. When the amount of external addition of the melamine-formaldehyde condensate fine powder is 5.0% by mass, "creep-out" appears at 9,325 sheets and 9,574 sheets in the continuous durability tests in the experiments (5) and (6), respectively, showing a normal level of the results. When the amount of external addition of the melamine-formaldehyde condensate fine powder is 5.5% by mass, on the other hand, "creep-out" appears at 4,535 sheets and 4,226 sheets of continuous durability tests in the experiments (5) and (6), showing a poor level of results. This is because a lot of the melamine-formaldehyde condensate fine powder is accumulated in the cleaning device 14 to increase the amount of "creep-out" of the melamine-formaldehyde condensate fine powder in the cleaning device 14. "Creep-out" was also independent of the amount of external addition of the inorganic fine powder A.

The experimental results in TABLE 1 indicate that the amount of external addition of the melamine-formaldehyde condensate fine powder sufficient for preventing both image defects and creep-out is in the range of 0.1 to 5.0% by mass.

The experiments shown in TABLE 2 and TABLE 3 are described in detail below.

TABLE 2: Image defects in the H/H environment with an image printing ratio of 4%, and creep-out in the L/L environment with an image printing ratio of 4% were confirmed by externally adding 0.1% by mass of the melamine-formaldehyde condensate fine powder and 2.0% by mass of the inorganic fine powder A, while changing the number average particle size of the melamine-formaldehyde condensate fine powder to 1 0.002 μm, 2 0.005 μm, 3 3.0 μm and 4 3.5 μm.

TABLE 3: Image defects in the H/H environment with an image printing ratio of 4%, and creep-out in the L/L environment with an image printing ratio of 4% were confirmed by externally adding 5% by mass of the melamine-formaldehyde condensate fine powder and 2.0% by mass of the inorganic fine powder A, while changing the number average particle size of the melamine-formaldehyde condensate fine powder to 1: 0.002 μm, 2: 0.005 μm, 3: 3.0 μm and 4: 3.5 μm. The photosensitive member (B) used in TABLE 1 was also used in TABLE 2 and TABLE 3.

TABLE 2

The relation between the number average particle size, and image defects and creep-out when 0.1% by mass of the melamine-formaldehyde condensate fine powder and 2.0% by mass of the inorganic fine powder A are externally added

| NUMBER AVERAGE PARTICLE SIZE OF MELAMINE-FORMALDEHYDE CONDENSATE FINE POWDER (μm) | 1<br>0.002 | 2<br>0.005 | 3<br>3.0 | 4<br>3.5 |
|---|---|---|---|---|
| IMAGE DEFECTS | (9656)<br>B | (9356)<br>B | (9218)<br>B | (3972)<br>C |
| CREEP-OUT | C | A | A | A |

TABLE 3

The relation between the number average particle size, and image defects and creep-out when 5% by mass of the melamine-formaldehyde condensate fine powder and 2.0% by mass of the inorganic fine powder A are externally added

| NUMBER AVERAGE PARTICLE SIZE OF MELAMINE-FORMALDEHYDE CONDENSATE FINE POWDER (μm) | 1<br>0.002 | 2<br>0.005 | 3<br>3.0 | 4<br>3.5 |
|---|---|---|---|---|
| IMAGE DEFECTS | A | A | A | (6712)<br>C |
| CREEP-OUT | C | A | A | A |

The results in TABLE 2 and TABLE 3 will be described in detail hereinafter.

TABLE 2 shows the experimental results when up to 10,000 sheets in the continuous durability tests were carried out using the toners in which respective melamine-formaldehyde condensate fine powders, whose number average particle sizes were divided into four ranges, were externally added in an amount of 0.1% by mass. The experiments in TABLE 2 were carried out by externally adding 2.0% by mass of the inorganic fine powder A, because creep-out is independent of the amount of external addition of the inorganic fine powder A, while the increased amount of the inorganic fine powder A is disadvantageous for image defects.

The letters A, B and C denotes good, normal and poor levels of the results, respectively. The numerals in the parenthesis denote the number of sheets when image defects or creep-out has appeared in the continuous durability test.

TABLE 2 shows that image defects are in normal level when the powders with the particle sizes of 1, 2 and 3 were used. Image defects occur at 3,972 sheets in the durability tests when the powder with the particle size of 4 was used. This is because a small amount of the melamine-formaldehyde condensate fine powder is externally added, but a large amount of the inorganic fine powder A is also externally added in the experiment shown in TABLE 1, so that the lubricant in the inorganic fine powder A is expanded at the latter half stage of the durability test, allowing the degree of wear to be a little decreased to generate slight image defects. However, since the particle size of the melamine-formaldehyde condensate fine powder is small, the surface of the photosensitive member 1 is uniformly scraped to enable image defects to be prevented until the latter half stage of the durability test. When the particle size of 4 is used, the surface of the photosensitive member 1 cannot be uniformly scraped, because the number average particle size of the melamine-formaldehyde condensate fine powder is larger as compared with the cases when the powders with the particle sizes of 1, 2 and 3 were used, making it impossible to uniformly scrape the surface of the photosensitive member 1 to leave irregular scrapes to generate image defects at the portion that has not been scraped.

Creep-out shows a good level of results when the powders with the particle sizes of 2, 3 and 4 were used.

Creep-out is observed at the initial stage of the durability test when the powder with the particle sizes of 1 was used. This is because, although the melamine-formaldehyde condensate fine powders having the large number average particle sizes of 2, 3 and 4 seldom creep out through the contact gap between the cleaning device 14 and photosensitive member 1, a large amount of the powder having a small number average particle size of 1 can creep out of the gap between the cleaning device 14 and photosensitive member 1.

TABLE 3 shows the experimental results when up to 10,000 sheets in the continuous durability tests were carried out using the toners in which respective melamine-formaldehyde condensate fine powders, whose number average particle sizes were divided into four ranges, were added in an amount of 5% by weight. The experiments in TABLE 3 were carried out by adding 2.0% by weight of the inorganic fine powder A as in the experiments in TABLE 2, because creep-out is independent of the amount of addition of the inorganic fine powder, while an increased amount of the inorganic fine powder A is disadvantageous for image defects.

The letters A, B and C in the table denote that the experimental results are at a good level, a normal level and a poor level, respectively. The numerals in the parenthesis denote the number of sheets when image defects or "creep-out" has appeared in the continuous durability test.

The powders with the particle sizes of 1, 2 and 3 give good levels of results with respect to image defects. The powder with the particle size of 4 gives a poor level of results since image defects have appeared at 6,712 sheets in the continuous durability test. This is because, shown in results in TABLE 2, since the number average particle size of the melamine-formaldehyde condensate fine powder is small when the powders with the particle sizes of 1, 2 and 3 were used, the surface of the photosensitive member 1 is uniformly scraped to enable image defects to be prevented. When the powder with a particle size of 4 is used, the surface of the photosensitive member 1 cannot be uniformly scraped because the number average particle size of the melamine-formaldehyde condensate fine powder is large, making it impossible to uniformly scrape the surface of the photosensitive member 1 to leave irregular scrapes to generate image defects at the portion that has not been scraped.

Good levels of experimental results are obtained with respect to creep-out when the powders having the particle sizes of 2, 3 and 4 were used.

Creep-out is observed at the initial stage of the durability test when the powder with the particle size of 1 is used because, although the melamine-formaldehyde condensate fine powders having the large number average particle sizes of 2, 3 and 4 seldom creep out through the contact gap between the cleaning device 14 and photosensitive member 1, a large amount of the powder having a small number average particle size of 1 can creep out of the gap between the cleaning device 14 and photosensitive member 1.

It is evident from the experimental results in TABLE 2 and TABLE 3 that image defects and creep-out can be sufficiently prevented only when the melamine-formaldehyde condensate fine powder has a number average particle size in the range of 0.005 to 3.00 $\mu$m when the amounts of addition of the melamine-formaldehyde condensate fine powder and inorganic fine powder A are adjusted in an appropriate range.

The experiments in TABLE 4 will be then described in detail below.

In the experiment in TABLE 4, the degree of image defects and creep-out were confirmed by changing the amount of addition of the inorganic fine powder A to the toner, where the melamine-formaldehyde condensate fine powder with a number average particle size of 0.3 $\mu$m was used for externally adding to the toner. The degree of image defects was confirmed in the experiments (1) and (2) by the continuous durability test in the H/H environment (the image printing ratio of 4%), while the degree of creep-out was confirmed in the experiments (3) and (4) by the continuous durability test in the H/H environment (the image printing ratio of 4%).

(1) The surface layer of the photosensitive member comprises a blend of the polycarbonate resins (I) and (II).

The melamine-formaldehyde condensate fine powder was externally added in a proportion of 0.1% by mass to the toner.

(2) The surface layer of the photosensitive member comprises a blend of the polycarbonate resins (I) and (II).

The melamine-formaldehyde condensate fine powder was externally added in a proportion of 5.0% by mass to the toner.

(3) The surface layer of the photosensitive member comprises a blend of the polycarbonate resins (I) and (II).

The melamine-formaldehyde condensate fine powder was externally added in a proportion of 0.1% by mass to the toner.

(4) The surface layer of the photosensitive member comprises a blend of the polycarbonate resins (I) and (II).

The melamine-formaldehyde condensate fine powder was externally added in a proportion of 5.0% by mass to the toner.

photosensitive member 1 is uniformly scraped without being affected by the amount of addition of the inorganic fine powder A since the amount of addition of the melamine-formaldehyde condensate fine powder is large, enabling the occurrence of image defects to be prevented.

TABLE 4

The relation between the amount of external addition of the inorganic fine powder A, and image defects and fusion of the toner

| | PHOTOSENSITIVE MEMBER* | INORGANIC FINE POWDER A (% BY MASS) → MELAMINE-FORMALDEHYDE CONDENSATE (% BY MASS) ↓ | 0 | 0.01 | 0.02 | 0.05 | 0.1 | 0.5 | 1.0 | 1.5 | 2.0 | 2.01 |
|---|---|---|---|---|---|---|---|---|---|---|---|---|
| (1) IMAGE DEFECTS | PHOTOSENSITIVE MATERIAL (B) | 0.1 | A | A | A | A | A | A | A | A | B | C |
| (2) IMAGE DEFECTS | PHOTOSENSITIVE MATERIAL (B) | 5.0 | A | A | A | A | A | A | A | A | A | A |
| (3) FUSION OF TONER | PHOTOSENSITIVE MATERIAL (B) | 0.1 | C | C | B | A | A | A | A | A | A | A |
| (4) FUSION OF TONER | PHOTOSENSITIVE MATERIAL (B) | 5.0 | C | C | B | B | A | A | A | A | A | A |

*The photosensitive material (B) is the same as the photosensitive material (B) use in TABLE 1.

The experimental results in TABLE 4 will be described in detail below.

TABLE 4 shows the experimental results of up to 10,000 sheets of the durability test, in which the amounts in external addition of the melamine-formaldehyde condensate fine powder were fixed to 0.1% and 5% by mass, while changing the amount of external addition of the inorganic fine powder A in the range of zero to 2.01% by mass. The letters A, B and C denote a good level, a normal level and a poor level, respectively.

Image defects do not appear at all in the experiment (1) in which zero to 1.5% by mass of the inorganic fine powder was externally added, showing a good level. This is because the surface of the photosensitive member 1 can be uniformly scraped owing to the added melamine-formaldehyde condensate fine powder without being affected by the inorganic fine powder A expanded with the cleaning device,. consequently preventing image defects.

A slight image defects appear at 9,748 sheets in the continuous durability test when 2.0% by mass of the inorganic fine powder A is externally added, indicating a normal level. This is because the inorganic fine powder A expanded with the cleaning device prevents the polishing effect of the melamine-formaldehyde condensate fine powder on the surface of the photosensitive member 1, causing a slight image defect at the latter half stage of the durability test.

Image defects appear at 4,365 sheets in the continuous durability test when the amount of external addition of the inorganic fine powder A is 2.01% by mass, showing a poor level. This is because the polishing effect of the melamine-formaldehyde condensate fine powder is blocked due to a large amount of the addition of the inorganic fine powder A expanded with the cleaning device, consequently causing image defects.

In short, image defects are effectively prevented when zero to 2% by mass of the inorganic fine powder A is externally added in the experiment (1).

A good level of the result is obtained in the experiment (2) in which zero to 2.01% by mass of the inorganic fine powder A is externally added. This is because the surface of the The amount of the external addition of the inorganic fine powder A in the range of zero to 2.0% by mass is effective with respect to image defects in the experiments (1) and (2).

No fusion of the toner appears when the amount of external addition of the inorganic fine powder A is in the range of 0.05 to 2.01% by mass in the experiment (3), showing a good level. This is because the lubricant in the inorganic fine powder A that is expanded with the cleaning device can fill up all the minute scrapes unevenly formed deep on the photosensitive member 1, thereby preventing nuclei that trigger fusion of the toner from being generated, or preventing fusion from occurring.

Fusion of the toner appears at 9,500 sheets in the continuous durability test when the amount of external addition of the inorganic fine powder A is 0.02% by mass, showing a normal level. This is because the minute scrapes unevenly formed deep on the photosensitive member 1 can not be completely filled since a small amount of the inorganic fine powder A containing the lubricant that is expanded with the cleaning device is added, generating nuclei that trigger fusion of the toner at the latter half stage of the durability test to consequently fuse the toner.

Fusion of the toner appears at 3,200 and 4,700 sheets of the durability test when the amount of addition of the inorganic fine powder is zero or 0.01% by mass, showing poor levels. This is because the toner and additives are accumulated at the portions where minute scrapes are unevenly formed to generate nuclei since there is no lubricant, or little lubricant, that is expanded with the cleaning device, causing fusion of the toner.

In summary, 0.02 to 2.01% by mass of the externally added inorganic fine powder A is effective for preventing fusion of the toner in the experiment (3).

Fusion of the toner is not observed at all when the amount of external addition of the inorganic fine powder A is in the range of 0.1 to 2.01% by mass in the experiment (4), indicating a good level. This is because the lubricant in the inorganic fine powder A that is expanded with the cleaning device can fill up all the minute scrapes unevenly formed deep on the photosensitive member 1, consequently preventing nuclei that trigger fusion of the toner to prevent fusion of the toner. While a larger amount of the melamine-formaldehyde condensate fine powder is externally added in this experiment than in the experiment (3), fusion of the toner is not caused when the amount of external addition of the inorganic fine powder A is in the range of 0.1 to 2.01% by mass.

Fusion of the toner appears at 9,300 and 9,700 sheets in the continuous durability test when the amount of external addition of the inorganic fine powder A is 0.02% by mass and 0.05% by mass, respectively, showing normal levels. This is because the minute scrapes unevenly formed deep on the photosensitive member 1 can not be completely filled up since a small amount of the inorganic fine powder A containing the lubricant that is expanded with the cleaning device is added, thereby accumulating the toner and external additives at the irregularly scraped portions at the latter half stage of the durability test to generate nuclei that trigger fusion of the toner, consequently generating slight fusion of the toner.

Fusion of the toner appears at 2,900 and 4200 sheets in the continuous durability tests when the amount of external addition of the inorganic fine powder A is zero and 0.01% by mass, showing a poor level of the result. This is because unevenly formed minute scrapes can not be filled with the lubricant since no, or little inorganic fine powder A containing the lubricants that is expanded with the cleaning device is added, thereby accumulating the toner and external additives at the portion of the uneven scrapes to form nuclei that triggers fusion of the toner. An amount of external addition of the inorganic fine powder A in the range of 0.02 to 2.01% by mass is effective for preventing fusion of the toner in the experiment (4).

A externally adding amount of the inorganic fine powder A in the range of 0.02 to 2.01% by mass is sufficient for preventing fusion of the toner from occurring in the experiments (3) and (4) when the amount of external addition of the melamine-formaldehyde condensate fine powder is considered.

The results in TABLE 4 indicate that the amount of external addition of the inorganic fine powder A that can satisfactorily prevent image defects and fusion of the toner is in the range of 0.02 to 2.0% by mass when the amount of external addition of the melamine-formaldehyde condensate fine powder is considered.

The results in TABLE 1 to TABLE 4 suggest that image defects, creep-out and fusion of the toner in the continuous durability test can be prevented when the number average particle size of the melamine-formaldehyde condensate fine powder to be externally added is in the range of 0.005 to 3.00 $\mu$m, the amount of external addition of it is in the range of 0.1 to 5.0% by mass, and the amount of external addition of the inorganic fine powder A is in the range of 0.02 to 2.0% by mass.

A good image having high image quality could be obtained by completely preventing image defects as well as creep-out and fusion of the toner, when the photosensitive member 1 has an appropriate wearing property while keeping the number average molecular weight of the melamine-formaldehyde condensate fine powder in the range of 0.005 to 3.00 $\mu$m, the amount of external addition of it in the range of 0.1 to 5.0% by mass, and the amount of external addition of the inorganic fine powder A in the range of 0.02 to 2.0% by mass.

Although the melamine-formaldehyde condensate fine powder was used as the resin fine powder in the present embodiment, the resin is not limited thereto so long as other resins have the same effect as the melamine resin. For example, a condensation product of benzoguanamine, melamine and formaldehyde can be used as well.

Although the second inorganic fine powder has a number average particle size of 8 $\mu$m, silicone oil is contained in a proportion of 40% by mass as a lubricant, and dimethyl silicone oil with a viscosity of 0.0125 $m^2/s$ (12,500 cSt) was used as a silicone oil, the external additives are not limited thereto provided that other external additives have the same effect as described previously.

The content of the lubricant in the second inorganic fine powder may be in the range of 25 to 90% by mass, preferably 30 to 90% by mass and more preferably 40 to 65% by mass, based on the total mass of the inorganic fine powder including the lubricant. When the content of the lubricant is less than 25% by mass, the fusion preventive effect is lost. When the content exceeds 90% by mass, fog of the image is increased.

The number average particle size of the second inorganic fine powder may be preferably in the range of 0.5 to 50 $\mu$m, and more preferably 3 to 20 $\mu$m. When the number average particle size is less than 0.5 $\mu$m, the number of particles in the toner is so increased that fluidity of the toner is reduced. When the number average particle size exceeds 50 $\mu$m, the number of particles in the toner is so reduced that the fusion preventive effect is deteriorates.

Second Embodiment

The second embodiment is described below.

The photosensitive member described in the first embodiment is used while a silica fine powder subjected to hydrophobic treatment, an alumina fine powder or a titanium oxide fine powder as the first fine powder, and an inorganic fine powder containing a lubricant as the second fine powder, were used as toner additives in the present embodiment. Silica is endowed with a hydrophobic property by chemically treating it with an organic silicon compound that reacts with or is physically absorbed to silica. A preferable method includes treating the silica fine powder, produced by a vapor oxidation of a halogenated silicon compound, with a silane coupling reagent, followed by simultaneously treating with the silane coupling reagent and an organic silicon compound. Drawings and a description of the apparatus, and a description of the photosensitive member 1 are omitted herein since they are the same as described in the first embodiment.

The toner 8 having a desired particle size distribution is prepared by the steps comprising: melting and kneading a mixture of a binding resin, a magnetic substance, a charge control agent and wax in a biaxial extruder heated at 130° C., coarsely crushing the cooled mixture with a hammer mill, finely grinding the coarse particles with a jet mill, and classifying the fine particles with an elbow classifier. A hydrophobic silica fine powder, treated with an organic silicon compound after treating with a silane coupling reagent as the first fine powder, and an inorganic fine powder blended with the silicon oil in a high proportion (referred as a "inorganic fine powder A" hereinafter) as the second fine powder, were externally added to the toner particles described above by mixing with a Henshel mixer. The inorganic fine powder A is the same as described in the first embodiment.

Image defects can be prevented by using the external additives described above in combination with the foregoing photosensitive member 1, besides enabling fusion of the toner to be prevented by the lubricant contained in the inorganic fine powder A. Good images with excellent fixing ability can be also obtained by using the additives described above.

Continuous durability tests were carried out using the photosensitive member 1 and toner 8 having such constructions as described above under the following conditions in a H/H environment of 32.5° C. and 80% RH with an image printing ratio of 4% to evaluate the degree of image defects. The degree of image defects was also evaluated as a comparative experiment using the photosensitive member 1 as the charge transfer layer 23 containing only the polycarbonate resin (II) with a viscosity average molecular weight of $2\times10^4$. Time-dependent durability of the image density was confirmed, and fixing ability was evaluated by a continuous durability test in a N/N environment of 23° C. and 60% RH with an image printing ratio of 4%. Creep-out of the silica fine powder in the cleaning device was also evaluated in a continuous durability test in a L/L environment of 15° C. and 10% RH with an image printing ratio of 4%.

In the experimental conditions, the amounts of external addition of the silica fine powder in the toner 8 were changed in the range of zero to 2.1% by mass, while fixing the amount of addition of the inorganic fine powder to 0.02% by mass or 2.0% by mass.

The number average particle size of the primary particles of the silica fine powder was 0.05 $\mu$m when zero to 2.1% by mass of the silica fine powder was externally added. When 0.8% by mass or 2.0% by mass of the silica fine powder was externally added, the particle size of it was changed to 0.002 $\mu$m, 0.005 $\mu$m, 2.5 $\mu$m and 3.5 $\mu$m to confirm image defects and creep-out of the silica particles in the cleaning device.

The continuous durability test was carried out in the H/H environment with an image printing ratio of 4% by changing the amount of addition of the inorganic fine powder A in the range of zero to 2.01% by mass to evaluate image defects and fusion of the tone, when the silica fine powder was externally added in a proportion of 0.8% by mass or 2.0% by mass.

The experiments in TABLE 5 will be described in detail hereafter.

In the experiments in TABLE 5, image defects and creep out were confirmed by changing the amount of external addition of the silica fine powder, the first fine powder having a number average particle size of the primary particles of 0.05 $\mu$m, to the toner in the range of zero to 2.1% by mass. Image defects were confirmed in the experiments (1) to (4) in the H/H environment (image printing ratio of 4%), solid densities were confirmed in the experiment (5) and (6) in the N/N environment (image printing ratio of 4%), and fixing ability was confirmed in the experiments (7) and (8) in the N/N environment (image printing ratio of 4%).

(1) Comparative experiment: The surface layer of the photosensitive member merely contains the polycarbonate resin (II). The amount of external addition of the inorganic fine powder A in the toner is 0.02% by mass.

(2) Comparative experiment: The surface layer of the photosensitive member merely contains the polycarbonate resin (II). The amount of external addition of the inorganic fine powder A in the toner is 2.0% by mass.

(3) The polycarbonate resin (I) and polycarbonate resin (II) are blended in the surface layer of the photosensitive member. The amount of external addition of the inorganic fine powder A in the toner is 0.02% by mass.

(4) The polycarbonate resin (I) and polycarbonate resin (II) are blended in the surface layer of the photosensitive member. The amount of external addition of the inorganic fine powder A in the toner is 2.0% by mass.

(5) The polycarbonate resin (I) and polycarbonate resin (II) are blended in the surface layer of the photosensitive member. The amount of external addition of the inorganic fine powder A in the toner is 0.02% by mass.

(6) The polycarbonate resin (I) and polycarbonate resin (II) are blended in the surface layer of the photosensitive member. The amount of external addition of the inorganic fine powder A in the toner is 2.0% by mass.

(7) The polycarbonate resin (I) and polycarbonate resin (II) are blended in the surface layer of the photosensitive member. The amount of external addition of the inorganic fine powder A in the toner is 0.02% by mass.

(8) The polycarbonate resin (I) and polycarbonate resin (II) are blended in the surface layer of the photosensitive member. The amount of external addition of the inorganic fine powder A in the toner is 2.0% by mass.

The photosensitive member (A), in which the same charge transfer layer as used in the first embodiment comprises a charge transfer substance, and a composition containing 100% by mass of the polycarbonate resin (I) with a viscosity average molecular weight of $5\times10^3$, was used in the experiments (1) and (2).

The photosensitive member (B), in which the same charge transfer layer as used in the first embodiment comprises a charge transfer substance, and a composition containing 40% by mass of the polycarbonate resin (I) with a viscosity average molecular weight of $5\times10^3$ and 60% by mass of the polycarbonate resin (II) with a viscosity average molecular weight of $2\times10^4$, was used in the experiments (3) to (8).

TABLE 5

The relation between the amount of external addition of the silica fine powder, and image defects, solid density and fixing ability

| | PHOTOSENSITIVE MEEMBER* | SILICA FINE POWDER (% BY MASS) → INORGANIC FINE POWDER A(% BY MASS) ↓ | 0 | 0.7 | 0.8 | 0.9 | 1.0 | 1.5 | 1.8 | 1.9 | 2.0 | 2.1 |
|---|---|---|---|---|---|---|---|---|---|---|---|---|
| (1) IMAGE DEFECTS IN COMPARATIVE EXPERIMENT | PHOTOSENSITIVE MATERIAL (A) | 0.02 | C | C | C | C | C | C | C | C | C | C |
| (2) IMAGE DEFECTS IN COMPARATIVE EXPERIMENT | PHOTOSENSITIVE MATERIAL (A) | 2.0 | C | C | C | C | C | C | C | C | C | C |

TABLE 5-continued

The relation between the amount of external addition of the silica fine powder, and image defects, solid density and fixing ability

| | PHOTOSENSITIVE MEEMBER* | SILICA FINE POWDER (% BY MASS) → INORGANIC FINE POWDER A(% BY MASS) ↓ | 0 | 0.7 | 0.8 | 0.9 | 1.0 | 1.5 | 1.8 | 1.9 | 2.0 | 2.1 |
|---|---|---|---|---|---|---|---|---|---|---|---|---|
| (3) IMAGE DEFECTS | PHOTOSENSITIVE MATERIAL (B) | 0.02 | C | B | A | A | A | A | A | A | A | A |
| (4) IMAGE DEFECTS | PHOTOSENSITIVE MATERIAL (B) | 2.0 | C | C | B | A | A | A | A | A | A | A |
| (5) SOLID DENSITY | PHOTOSENSITIVE MATERIAL (B) | 0.02 | C | C | B | A | A | A | A | A | A | A |
| (6) SOLID DENSITY | PHOTOSENSITIVE MATERIAL (B) | 2.0 | C | C | B | A | A | A | A | A | A | A |
| (7) FIXING ABILITY | PHOTOSENSITIVE MATERIAL (B) | 0.02 | A | A | A | A | A | A | A | A | A | B |
| (8) FIXING ABILITY | PHOTOSENSITIVE MATERIAL (B) | 2.0 | A | A | A | A | A | A | A | A | B | C |

TABLE 5 shows the results of continuous durability tests up to 10,000 sheets. The solid density was measured with a Macbeth photodensitometer (made by Macbeth Co., Ltd.). The worst result is indicated with respect to the solid density and fixing ability.

The letters A, B and C in the table denote a good level without any problem, a normal level and a poor level, respectively. The densities of 1.3 or more, 1.25 to less than 1.3, and less than 1.25 were marked by A (good level), B (normal level) and C (poor level), respectively, with respect to the solid density.

No image defects occur in the experiment (3) when the amount of external addition of the inorganic fine powder A is 0.02% by mass, irrespective of the amount of external addition of silica in the range of 0.8 to 2.1% by mass. This is because the photosensitive member 1 is uniformly worn by the silica fine powder transferred on the surface of the photosensitive member 1, locally leaving low resistive adhesion substances to prevent image defects from occurring. Since a small amount of the inorganic fine powder A is externally added, the quantity of the lubricant to be expanded on the photosensitive member 1 is also small, thereby removing the low resistive substances on the photosensitive member 1 to completely prevent image defects from occurring.

When the silica fine powder is added in a proportion of 0.7% by mass, image defects appear at 9,66 sheets in the continuous durability test, showing a normal level. This is because minute portions on the photosensitive member 1 remain not to be polished due to a small amount of the silica fine powder externally added, and low resistive substances are not completely removed to generate slight image defects at the latter half stage of the durability test.

Image defects appear at 3,254 sheets in the continuous durability test when the amount of external addition of the silica fine powder is zero, indicating a poor level. This is because no silica fine powder for polishing the surface of the photosensitive member 1 is externally added to the toner, making it impossible to remove the low resistive substance generated on the surface of the photosensitive member 1 to cause image defects.

It may be concluded from the discussions above that externally adding 0.7 to 2.1% by mass of the silica fine powder is effective for preventing image defects in the experiment (3).

Image defects do not appear at all when 0.9 to 2.1% by mass of the silica fine powder is externally added in the experiment (4), showing a good level. This is because the surface of the photosensitive member 1 is uniformly worn by the silica fine powder transferred on surface of the photosensitive member 1, locally leaving low resistive adhesion substances to prevent image defects from occurring. Since the amount of external addition of the inorganic fine powder A is also small, a small amount of the lubricant to be expanded on the surface of the photosensitive member 1 exists on surface of the photosensitive member 1, thereby removing the low resistive substances on the surface of the photosensitive member 1 to prevent image defects from being generated.

When 0.8% by mass of the silica fine powder is externally added, image defects appear at 9,454 sheets in the continuous durability test, showing a normal level. This is because a small amount of the silica fine powder is externally added while externally adding 2.0% by mass of the inorganic fine powder A caused there to remain a little lubricant to be expanded on the surface of the photosensitive member 1, thereby locally causing low resistive to remain on the surface of the photosensitive member 1. In other words, minute non-polished portions are generated on the surface and the low resistive substances are not completely removed, causing slight image defects at the latter half stage of the durability test.

When the silica fine powder is externally added in a proportion of zero and 0.7% by mass, image defects appear at 3,545 sheets and 5,698 sheets of the durability tests, respectively, showing poor levels. This is because no, or little silica fine powder for polishing the surface of the toner is externally added, while externally adding 2.0% by mass of the inorganic fine powder A, causing there to remain little lubricant to be expanded on the surface of the photosensitive member 1, also leaving the low resistive substances on the surface of the photosensitive member 1 to cause image defects.

It is evident in the experiment (4) that image defects are effectively prevented by externally adding 0.8 to 2.1% by mass of the silica fine powder.

Accordingly, adding 0.8 to 2.1% by mass of the silica fine powder is effective for preventing image defects in the experiment (3) and (4) when the amount of external addition of the inorganic fine powder A is considered.

When the photosensitive member having a surface layer comprising only the polycarbonate resin (II) with a viscosity average molecular weight of $2\times10^4$ is used, on the other hand, image defects appear at 500 sheets or less in the continuous durability test irrespective of the amount of external addition of the silica fine powder in the range of zero to 2.1% by mass, showing a poor level. This is because, since the surface of the photosensitive member has no wearing property, the surface of the photosensitive member is not worn even when the amount of external addition of the silica fine powder is increased, consequently generating image defects.

The results described above show that image defects can be prevented when the surface of the photosensitive member 1 has an appropriate wearing property, and a proper amount of the external additives having a polishing effect are externally added to the toner to uniformly scrape the surface of the photosensitive member.

A solid density of 1.3 or more is obtained when 0.9% by mass or more of the silica fine powder is externally added in the experiment (5), showing a good level. This is because this amount of external addition of the silica fine powder allows the toner to be endowed with an electrostatic charge sufficient for assuring development and transfer.

The solid density becomes 1.28 when 0.8% by mass of the silica fine powder is externally added, showing a normal level. When the amount of external addition of the silica fine powder is zero and 0.7, the reflection optical densities show poor levels of 1.0 and 1.2, respectively. This is because the toner can not be sufficiently charged since a small amount of the silica fine powder is externally added to the tone.

The experiments (6) and (5) showed similar results. The solid density was independent of the amount of external addition of the inorganic fine powder A.

It is evident from the above discussions that the amount of external addition of the silica fine powder in the range of 0.8 to 2.1% by mass is sufficient for improving the solid density.

Fixing ability is in a good level when zero to 2.0% by mass of the silica fine powder is externally added in the experiment (7).

Fixing ability is decreased a little but is at a normal level when 2.1% by mass of the silica fine powder is externally added. Although silica fine powder that does not melt at the fixing temperature lie on the image when 2.1% by mass of the silica fine powder is externally added, the fixing level is little affected by the overlaying powder. The lubricant contained in the inorganic fine powder A also causes a deterioration in fixing ability, since it is not completely adhered after fixing. However, fixing ability is not so severely affected by the lubricant in this embodiment since a small amount of the lubricant is externally added in this embodiment.

The fixing ability shows a good level when zero to 1.9% by mass of the silica fine powder is externally added in the experiment (8).

When 2.0% by mass of the silica fine powder is externally added, the fixing ability is at a normal level, though it becomes a little poor. Although silica fine powder that does not melt at the fixing temperature lie on the image when 2.1% by mass of the silica fine powder is externally added, the fixing level is little affected by the overlaying powder. The lubricant contained in the inorganic fine powder A also causes a deterioration in fixing ability, since it is not completely adhered after fixing. The lubricant little affects the fixing ability since 2.0% by mass of the inorganic fine powder A is externally added in the experiment (8).

The fixing ability is at a poor level when 2.1% by mass of the silica fine powder is externally added. Fixing ability deteriorates because the silica fine powder that does not melt at the fixing temperature lies on the image when a lot of silica fine powder is externally added to the toner. One reason for deterioration of the fixing ability is that the inorganic fine powder A is externally added in a proportion of 2.0% by mass.

The experiments (7) and (8) show that an amount of external addition of silica fine powder in the range of zero to 2.0% by mass is sufficient for improving the fixing ability.

It can be concluded that the solid density and fixing ability becomes satisfactory in all the continuous durability tests when 0.8 to 2.0% by mass of the silica fine powder is externally added.

The experiments in TABLE 6 and TABLE 7 will be described in detail below.

TABLE 6: Image defects in the H/H environment with a printing ratio of 4%, and creep-out in the L/L environment with a printing ratio of 4%, were confirmed by externally adding 0.8% by mass of the silica fine powder and 2.0% by mass of the inorganic fine powder A, while changing the number average particle size of the silica fine powder to 1:0.002 μm, 2: 0.005 μm, 3: 2.5 μm, and 4: 3.5 μm.

TABLE 7: Image defects in the H/H environment with a printing ratio of 4%, and creep-out in the L/L environment with a printing ratio of 4%, were confirmed by externally adding 5% by mass of the silica fine powder and 2.0% by mass of the inorganic fine powder A, while changing the number average particle size of the silica fine powder to 1: 0.002 μm, 2: 0.005 μm, 3: 2.5 μm, and 4: 3.5 μm.

TABLE 6

The relation between the number average particle size, and image defects and creep-out when 2.0% by mass of the silica fine powder and 2.0% by mass of the inorganic fine powder A are externally added

| NUMBER AVERAGE PARTICLE SIZE OF SILICA FINE POWDER (μm) | 1<br>0.002 | 2<br>0.005 | 3<br>2.5 | 4<br>3.5 |
|---|---|---|---|---|
| IMAGE DEFECTS | (9775)<br>B | (9454)<br>B | (9212)<br>B | (4385)<br>C |
| CREEP-OUT | C | A | A | A |

TABLE 7

The relation between the number average particle size, and image defects and creep-out when 2.0% by mass of the silica fine powder and 2.0% by mass of the inorganic fine powder A are externally added

| NUMBER AVERAGE PARTICLE SIZE OF SILICA FINE POWDER (μm) | 1<br>0.002 | 2<br>0.005 | 3<br>2.5 | 4<br>3.5 |
|---|---|---|---|---|
| IMAGE DEFECTS | A | A | A | (7840)<br>C |
| CREEP-OUT | C | A | A | A |

The results in TABLE 6 and TABLE 7 will be described in detail hereinafter.

TABLE 6 shows the experimental results when up to 10,000 sheets in the continuous durability tests were carried out by externally adding 0.8% by mass of the fine silica powder, whose number average particle size is divided into four ranges, into the toner. The inorganic fine powder A was externally added in a proportion of 2.0% by mass in the experiments listed in TABLE 6, because creep-out is independent of the amount of external addition of the inorganic fine powder while an increased amount of the inorganic fine powder A is disadvantageous for image defects.

The letters A, B and C denote that the experimental results are at a good level, a normal level and a poor level, respectively. The numerals in the parenthesis denote the number of sheets when image defects or creep-out has appeared in the continuous durability test.

TABLE 6 shows that the experiments 1, 2 and 3 gives normal levels. Image defects appear in the experiment 4 at 4,385 sheets in the continuous durability tests, giving a poor level. This is because the lubricant in the inorganic fine powder A is expanded on the surface of the photosensitive member 1 at the latter half stage of the durability test since a small amount of the silica fine powder and a large a amount of the inorganic fine particle A are externally added in the experiments listed in TABLE 6, thereby slightly diminishing the degree of polishing to cause slight image defects. However, the surface of the photosensitive member 1 can be uniformly scraped up to the latter half stage of the durability test because the silica fine powders externally added in the experiments 1, 2 and 3 have a small number average particle size, enabling image defects to be prevented until the latter half stage of the durability test. The silica fine powder in the experiment 4 has a larger number average particle size than the corresponding powders in the experiments 1, 2 and 3, so that the surface of the photosensitive member 1 cannot be uniformly scraped to cause uneven scrapes consequently generating image defects at the portions that have not been scraped.

The experiments 2, 3 and 4 give a good level of results with respect to creep-out.

Creep-out appears at the initial stage of the durability test in the experiment 1. This is because, although a small proportion of the silica fine powder having large number average particle size creeps out of the contact gap between the cleaning device 14 and the photosensitive member 1 in the experiments 2, 3 and 4, a large amount of the silica fine powder having a small number average particle size creeps out of the contact gap between the cleaning device 14 and the photosensitive member 1.

TABLE 7 shows the results up to 10,000 sheets of the durability tests in which 2.0% by mass of the silica fine powders, whose number average particle sizes are divided into four ranges, were externally added into the toner. The inorganic fine powder A was externally added in a proportion of 2.0% by mass in the experiment in TABLE 7 as in the experiments in TABLE 6, because creep-out is independent of the amount of external addition of the inorganic fine powder while an increased amount of the inorganic fine powder A is disadvantageous for image defects.

The letters A, B and C denote that the experimental results are at a good level, a normal level and a poor level, respectively. The numerals in the parenthesis denote the number of sheets when image defects or creep-out has appeared in the continuous durability test.

The experiments 1, 2 and 3 give good levels with respect to image defects. Image defects appear at 7,840 sheets in the continuous durability test in the experiment 4, showing a poor level. This is because the surface of the photosensitive member 1 can be uniformly scraped as in the TABLE 6, since the silica fine powders have small number average particle sizes in the experiments 1, 2 and 3, allowing image defect to be prevented. The surface of the photosensitive member 1 cannot be uniformly scraped due to the large number average particle size in the experiment 4 to form uneven scrapes, consequently generating image defects at the non-scraped portions.

The experiments 2, 3 and 4 give good levels with respect to creep-out.

Creep-out appears at the initial stage of the durability test in the experiment 1 because, although a small proportion of the silica fine powder having large number average particle size creeps out of the contact gap between the cleaning device 14 and the photosensitive member 1 in the experiments 2, 3 and 4, a large amount of the silica fine powder having a small number average particle size creeps out of the contact gap between the cleaning device 14 and the photosensitive member 1 in the experiment 1.

The results in TABLE 6 and TABLE 7 show that a number average particle size in the range of 0.005 to 2.5 $\mu$m can satisfactorily prevent both image defects and creep-out when the amounts of addition of the silica fine powder and inorganic fine powder A are considered.

In summary, it is concluded that prevention of image defects, solid density, fixing ability and prevention of creep-out are all satisfied when the silica fine powder having a number average particle size in the range of 0.005 to 2.5 $\mu$m is externally added in a proportion of 0.8 to 2.0% by mass.

The experiments listed in TABLE 8 will be described in detail hereinafter.

Fusion of the toner was confirmed in the experiments listed in TABLE 8 by changing the amount of external addition of the inorganic fine powder A to the toner, wherein image defects were confirmed in the H/H environment (image printing ratio of 4%) in the experiments (1) and (2), and fusion of the toner was confirmed in the H/H environment (image printing ratio of 4%) in the experiments (3) and (4).

(1) The surface layer of the photosensitive member comprises a blend of the polycarbonate resin (I) and polycarbonate resin (II) while adding 0.8% by mass of the silica fine powder to the toner.

(2) The surface layer of the photosensitive member comprises a blend of the polycarbonate resin (I) and polycarbonate resin (II) while adding 2.0% by mass of the silica fine powder to the toner.

(3) The surface layer of the photosensitive member comprises a blend of the polycarbonate resin (I) and polycarbonate resin (II) while adding 0.8% by mass of the silica fine powder to the toner.

(4) The surface layer of the photosensitive member comprises a blend of the polycarbonate resin (I) and polycarbonate resin (II) while adding 2.0% by mass of the silica fine powder to the toner.

TABLE 8

The relation between the amount of external addition of the inorganic fine powder A, and image defects and fusion of the toner

| | PHOTOSENSITIVE MEMBER* | INORGANIC FINE POWDER A (% BY MASS) SILICA FINE POWDER → (% BY MASS) ↓ | 0 | 0.01 | 0.02 | 0.05 | 0.1 | 0.5 | 1.0 | 1.5 | 2.0 | 2.01 |
|---|---|---|---|---|---|---|---|---|---|---|---|---|
| (1) IMAGE DEFECTS | PHOTOSENSITIVE MATERIAL (B) | 0.8 | A | A | A | A | A | A | A | A | B | C |
| (2) IMAGE DEFECTS | PHOTOSENSITIVE MATERIAL (B) | 2.0 | A | A | A | A | A | A | A | A | A | A |
| (3) FUSION OF TONER | PHOTOSENSITIVE MATERIAL (B) | 0.8 | C | C | B | A | A | A | A | A | A | A |
| (4) FUSION OF TONER | PHOTOSENSITIVE MATERIAL (B) | 2.0 | C | C | B | B | A | A | A | A | A | A |

*The photosensitive member (B) is the same as the photosensitive member (B) used in TABLE 5.

The results in TABLE 8 will be described in detail.

TABLE 8 shows the experimental results of up to 10,000 sheets in the durability test in the H/H environment when the amounts of external addition of the inorganic fine powder A were changed in the range of zero to 2.01% by mass while externally adding 0.8 and 2.0% by mass of the silica fine powder. The letters A, B and C denote a good level, a normal level and a poor level, respectively.

No image defects appear in the experiment (1) where zero to 1.5% by mass of the inorganic fine powder A is externally added, showing a good level. This is because the silica fine powder uniformly scrapes the surface of the photosensitive member 1 without being affected by the inorganic fine powder A expanded with the cleaning device, consequently preventing image defects from being generated.

Slight image defects appeared at 9,841 sheets in the continuous durability test when 2.0% by mass of the inorganic fine powder was externally added, indicating a normal level. This is because the inorganic fine powder A to be expanded with the cleaning device inhibits the polishing effect of the silica fine powder A on the photosensitive member 1, generating slight image defects at the latter half stage of the durability test.

Image defects appear at 4,368 sheets in the continuous durability test when 2.01% by mass of the inorganic fine powder A is externally added, showing a poor level. This is because a large amount of the inorganic fine powder A to be expanded with the cleaning device inhibits the polishing effect of the silica fine powder on the photosensitive member 1 to generate image defects.

In summary, image defects are effectively prevented when zero to 2% by mass of the inorganic fine powder A is externally added in the experiment (1). The experiment (2) shows good levels in all the range of external addition of the inorganic fine powder A of zero to 2.0% by mass. This is because external addition of a large amount of the silica fine powder allows the photosensitive member 1 to be uniformly scraped without being affected by the amount of external addition of the inorganic fine powder A, enabling image defects to be prevented.

The results in the experiment (1) and (2) show that image defects are effectively prevented when zero to 2.0% by mass of the inorganic fine powder A is externally added.

Fusion of the toner does not appear at all in the experiment (3) when 0.05 to 2.01% by mass of the inorganic fine powder A is externally added, showing good levels. This is because the lubricant in the inorganic fine powder A to be expanded with the cleaning device can fill up minute uneven scrapes deeply formed on the photosensitive member 1, thus preventing the generation of nuclei that trigger fusion of the toner, or preventing generation of fusion.

Fusion of the toner appears at 9,000 sheets in the durability test when 0.02% by mass of the inorganic fine powder A is externally added, showing a normal level. This is because minute uneven scrapes deeply formed on the photosensitive member 1 can not be completely buried due to small amount of the lubricant in the inorganic fine powder A to be expanded in the cleaning device, thereby generating nuclei that trigger fusion of the toner at the latter half stage of the durability test, consequently causing fusion of the toner.

Fusion of the toner appears at 4,400 sheets in the continuous durability test when zero to 0.01% by mass of the inorganic fine powder A is externally added, indicating a poor level. This is because there is no, or little lubricant in the inorganic fine powder A to be expanded with the cleaning device, so that nuclei are formed by accumulating the toner and external additives at the portions where fine scrapes are unevenly formed to trigger fusion of the toner.

Fusion of the toner is effectively prevented in the experiment (3) by externally adding 0.02 to 2.01% by mass of the inorganic fine powder A.

Fusion of the toner does not appear at all in the experiment (4) when 0.1 to 2.01% by mass of the inorganic fine powder A is externally added, showing good levels. This is because the lubricant in the inorganic fine powder A to be expanded in the cleaning device can fill-up fine irregular scrapes deeply formed on the surface of the photosensitive member 1, preventing generation of nuclei that trigger fusion of the toner, or preventing fusion of the toner. While the amount of external addition of the inorganic fine powder A is larger in the experiment (4) than in the experiment (3), fusion of the toner does not appear when 0.1 to 2.01% by mass of the inorganic fine powder is externally added.

Fusion of the toner appears at 9,200 and 9,600 sheets in the continuous durability tests when 0.02 and 0.05% by mass of the inorganic fine powders A are externally added, respectively, showing normal levels of the results. This is because a small amount of the lubricant in the inorganic fine powder A to be expanded in the cleaning device cannot fill-up fine irregular scrapes deeply formed on the surface of the photosensitive member 1, accumulating the toner an external additives at the unevenly scraped portions to cause nuclei that trigger fusion of the toner to appear, consequently generating slight fusion of the toner.

Fusion of toner appears at 3,100 and 40,000 sheets in the continuous durability test when zero and 0.01 by mass of the inorganic fine powder A is externally added, showing poor levels. This is because there is no, or little lubricant in the inorganic fine powder A to be expanded with the cleaning device, so that the lubricant can not completely cover minute irregular scrapes to accumulate the toner and external additives at the irregularly scraped portions and fusion of the toner appears. Fusion of the toner is effectively prevented by externally adding 0.02 to 2.01% by mass of the inorganic fine powder in the experiment (4).

When the amount of external addition of the silica fine powder is considered, fusion of the toner can be prevented by externally adding the inorganic fine powder A in a proportion of 0.02 to 2.01% by mass in the experiment (3) and (4).

The experimental results in TABLE 8 suggest that image defects and fusion of the toner can be satisfactorily prevented by externally adding 0.02 to 2.0% by mass of the inorganic fine powder A, when the amount of external addition of the silica fine powder is considered.

The results in TABLE 5 to TABLE 8 indicate that all of the conditions for preventing image defects, creep-out and fusion of the toner, and for obtaining sufficient solid density and fixing ability, after the continuous durability tests are satisfied when 0.8 to 2.0% by mass of the silica fine powders with number average particle sizes of 0.005 to 2.5 μm are externally added, while adding 0.02 to 2.0% by mass of the inorganic fine powder A.

When the surface of the photosensitive member 1 has an appropriate wearing property while adding 0.1% to 5.0% by mass, preferably 0.8 to 2.0% by mass, of the silica fine powder having a particle size of 0.005 to 3.00 μm, preferably 0.8 to 2.0 μm, and keeping the amount of addition of the inorganic fine powder A to 0.02 to 2.0% by mass, image defects can be completely prevented from occurring. In addition, creep-out and fusion of the toner can be prevented, and the solid density and fixing ability become satisfactory to enable a high quality image to be obtained.

While the silica fine powder was used in the present embodiment, the powder is not limited thereto so that an alumina powder or titanium oxide powder may be also used so long as they have the same effects as hitherto described.

While the second inorganic fine powder having a number average particle size of 8 μm is used, and the lubricant contains 40% by mass of silicon oil comprising dimethyl silicon oil having a viscosity of 0.0125 $m^2/s$ (12,500 cSt) in the present embodiment, they are not limited thereto but other external additives may be used so long as they have the same effect as hitherto described.

The second inorganic fine powder may contain the lubricant in a proportion of 25 to 90% by mass, preferably 30 to 90% by mass, and more preferably 40 to 65% by mass based on the mass of the inorganic fine powder including the lubricant as described in the first embodiment. The number average particle size is preferably in the range of 0.5 to 50 μm, more preferably in the range of 3 to 20 μm.

Third Embodiment

The third embodiment according to the present invention will be described hereinafter.

The photosensitive member described in the first embodiment is used, wherein a fine powder of strontium titanate, cerium oxide or magnesium oxide as the first fine powder, and an inorganic fine powder containing a lubricant as the second fine powder are used as toner external additives in the present embodiment. Drawings and a description of the apparatus, and description of the photosensitive member 1 are omitted herein since they are the same as described in the first embodiment.

The toner 8 having a desired particle size distribution is prepared by the steps comprising: melting and kneading a mixture of a binding resin, a magnetic substance, a charge control agent and wax in a biaxial extruder heated at 130° C., coarsely crushing the cooled mixture with a hammer mill, finely pulverizing the coarse particles with a jet mill, and classifying the fine particles with an elbow classifier. The strontium titanate fine powder as the first fine powder, and an inorganic fine powder blended with the silicon oil in a high proportion (referred as a "inorganic fine powder A" hereinafter) as the second fine powder, were externally added to the toner particles described above by mixing with a Henshel mixer. The inorganic fine powder A is the same as described in the first embodiment.

Image defects can be prevented by using the external additives described above in combination with the foregoing photosensitive member 1, besides preventing fusion of the toner by the lubricant contained in the inorganic fine powder A. Good images can be also obtained by suppressing filming and tailing at a high level.

Continuous durability tests were carried out using the photosensitive member 1 and toner 8 having such constructions as described above under the following conditions in a H/H environment of 32.5° C. and 80% RH with an image printing ratio of 4% to evaluate the degree of image defects. The degree of image defects was also evaluated as a comparative experiment using the photosensitive member 1 as the charge transfer layer 23 containing only the polycarbonate resin (II) with a viscosity average molecular weight of $2\times10^4$. Time-dependent durability of the image density was confirmed, and tailing of the image after fixing was evaluated by a continuous durability test in a N/N environment of 23° C. and 60% RH with an image printing ratio of 4%. Creep-out of the strontium titanate fine powder in the cleaning device was also evaluated in a continuous durability test in a L/L environment of 15° C. and 10% RH with an image printing ratio of 4%.

The amount of external addition of the strontium titanate fine powder in the toner 8 was changed in the range of zero to 4.5% by mass with a fixed amount of external addition of the inorganic fine powder A of 0.02% or 2.0% by mass in the experimental conditions.

The number average particle size of the primary particles in the strontium titanate fine powder was fixed to 1 μm when zero to 2.1% by mass of the strontium titanate fine powder was externally added, but the number average particle size was changed to 0.05 μm, 0.01 μm, 3 μm and 3.5 μm when 0.1% by mass or 4.0% by weight of the strontium titanate fine powder was externally added to confirm image defects and creep out of the strontium titanate fine powder (referred as "creep-out" hereinafter).

The amount of external addition of the inorganic fine powder A was changed in the range of zero to 2.01% by mass while adding a fixed amount of the strontium titanate fine powder of 0.1 or 4.0% by mass, and image defects and fusion of the toner were evaluated in a H/H environment with an image printing ratio of 4%.

The experiments in TABLE 9 will be described hereinafter in detail.

In TABLE 9, image defects and creep-out were confirmed by changing the amount of external addition of the strontium titanate fine powder (the first fine powder) with a number average particle size of 1 μm in the range of zero to 4.5% by mass to the toner. Image defects were confirmed in the experiments (1) to (4) in the H/H environment (image printing ratio 4%), filming confirmed in the experiments (5) and (6) in the N/N environment (image printing ratio 4%), and tailing was confirmed in the experiments (7) and (8) in the N/N environment (image printing ratio 4%).

a composition comprising a charge transfer substance and 100% by mass of the polycarbonate resin (II) with a viscosity average molecular weight of $2\times10^{4}$, was used in the experiments (1) and (2).

The photosensitive member (B), in which the same charge transfer layer as used in the first embodiment is composed of a composition comprising a charge transfer substance and 40% by mass of the polycarbonate resin (I) with a viscosity average molecular weight of $5\times10^{3}$ and 60% by mass of the polycarbonate resin (II) with a viscosity average molecular weight of $2\times10^{4}$, was used in the experiments (3) to (8).

TABLE 9

The relation between the amount of external addition of the strontium titanate fine powder, and image defects, filming and tailing

| | PHOTOSENSITIVE MEMBER* | STRONTIUM TITANATE FINE POWDER (% BY MASS) → INORGANIC FINE POWDER A (% BY MASS) ↓ | 0 | 0.1 | 0.5 | 1.0 | 2.0 | 3.0 | 3.5 | 4.0 | 4.1 | 4.5 |
|---|---|---|---|---|---|---|---|---|---|---|---|---|
| (1) IMAGE DEFECTS IN COMPARATIVE EXPERIMENT | PHOTOSENSITIVE MATERIAL (A) | 0.02 | C | C | C | C | C | C | C | C | C | C |
| (2) IMAGE DEFECTS IN COMPARATIVE EXPERIMENT | PHOTOSENSITIVE MATERIAL (A) | 2.0 | C | C | C | C | C | C | C | C | C | C |
| (3) IMAGE DEFECTS | PHOTOSENSITIVE MATERIAL (B) | 0.02 | C | A | A | A | A | A | A | A | A | A |
| (4) IMAGE DEFECTS | PHOTOSENSITIVE MATERIAL (B) | 2.0 | C | B | A | A | A | A | A | A | A | A |
| (5) FILMING | PHOTOSENSITIVE MATERIAL (B) | 0.02 | A | A | A | A | A | A | A | B | C | C |
| (6) FILMING | PHOTOSENSITIVE MATERIAL (B) | 2.0 | A | A | A | A | A | A | A | A | B | B |
| (7) TAILING | PHOTOSENSITIVE MATERIAL (B) | 0.02 | C | B | A | A | A | A | A | A | A | A |
| (8) TAILING | PHOTOSENSITIVE MATERIAL (B) | 2.0 | C | B | A | A | A | A | A | A | A | A |

(1) Comparative experiment: The surface of the photosensitive member contains only the polycarbonate resin (I). The toner contains 0.02% by mass of the inorganic fine powder A.

(2) Comparative experiment: The surface of the photosensitive member contains only the polycarbonate resin (I). The toner contains 2.0% by mass of the inorganic fine powder A.

(3) The surface of the photosensitive member comprises a blend of the polycarbonate resins (I) and (II). The toner contains 0.02% by mass of the inorganic fine powder A.

(4) The surface of the photosensitive member comprises a blend of the polycarbonate resins (I) and (II). The toner contains 2.0% by mass of the inorganic fine powder A.

(5) The surface of the photosensitive member comprises a blend of the polycarbonate resins (I) and (II). The toner contains 0.02% by mass of the inorganic fine powder A.

(6) The surface of the photosensitive member comprises a blend of the polycarbonate resins (I) and (II). The toner contains 2.0% by mass of the inorganic fine powder A.

(7) The surface of the photosensitive member comprises a blend of the polycarbonate resins (I) and (II). The toner contains 0.02% by mass of the inorganic fine powder A.

(8) The surface of the photosensitive member comprises a blend of the polycarbonate resins (I) and (II). The toner contains 2.0% by mass of the inorganic fine powder A.

The photosensitive member (A), in which the same charge transfer layer as used in the first embodiment is composed of TABLE 9 represents the results of 10,000 sheets in the continuous durability test.

The letters A, B and C denote a good level, a normal level and a poor level of the results.

No image defects appear when 0.1% by mass to 4.5% by mass of the strontium titanate fine powder was externally added at an amount of external addition of the inorganic fine powder A of 0.02% by mass in the experiment (3), showing a good level. This is because the surface of the photosensitive member 1 can be uniformly worn with the strontium titanate fine powder transferred on the photosensitive member 1, locally leaving low resistive adhesion substances to cause image defects. The amount of the lubricant to be expanded on the photosensitive member 1 is small since a small amount of the inorganic fine powder A is externally added, thereby removing the low resistive substance on the photosensitive member 1 to be completely fully free from image defects.

Image defects appear at 2,656 sheets in the continuous durability test when no strontium titanate fine powder is externally added, showing a poor level. This is because, since no strontium titanate fine powder for polishing the surface of the photosensitive member 1 is externally added to the toner, the low resistive substance generated on the surface of the photosensitive member 1 can not be removed to cause image defects.

It is evident from the experiment (3) that image defects are effectively prevented by externally adding 0.1 to 4.5% by mass of the strontium titanate fine powder.

Image defects do not appear at all when 0.5 to 4.5% by mass of the strontium titanate fine powder in the experiment (4) is externally added, showing a good level. This is because the surface of the photosensitive member 1 can be uniformly worn with the strontium titanate fine powder transferred on the photosensitive member 1, locally leaving the low resistive adhesion substances to cause no image defects. Although a rather larger amount of the inorganic fine powder A of 2.0% by mass is externally added to consequently increase the amount of the lubricant to be expanded on the photosensitive member 1, image defects do not occur at all since the powder has a large polishing effect of the surface of the photosensitive member 1.

Slight image defects appear at 9,285 sheets in the continuous durability test when 0.1% by mass of the strontium titanate fine powder is externally added, showing a good level. This is because non-polished minute portions appear on the photosensitive member 1 due to small amount of external addition of the strontium titanate fine powder. Moreover, the photosensitive member 1 is covered with the lubricant since the inorganic fine powder A is externally added in as large a proportion as 2.0% by mass, thereby making it impossible to completely remove the low resistive substance to cause slight image defects at the latter half stage of the durability test.

Image defects appear at 2,113 sheets in the continuous durability test when no strontium titanate fine powder is externally added. This is because the low resistive substance generated on the photosensitive member 1 can not be removed since no strontium titanate fine powder for polishing the surface of the photosensitive member 1 is externally added to the toner, causing image defects.

The experiment (4) suggests that image defects can be effectively prevented when 0.1 to 4.5% by mass of the strontium titanate fine powder is externally added.

The experimental results in the experiments (3) and (4) show that an amount of external addition of the strontium titanate fine powder in the range of 0.1 to 4.5% by mass is effective for preventing image defects, when the amount of external addition of the inorganic fine powder A is considered.

There is no problem in filming when zero to 3.5% by mass of the strontium titanate fine powder is externally added in the experiment (5), showing a good level without any problems.

A slight filming appears when 4.0% by mass of the strontium titanate fine powder is externally added, showing a normal level.

Filming appears at 1,998 sheets in the continuous durability test when 4.1% by mass of the strontium titanate fine powder is externally added, and at 1,685 sheets in the continuous durability test when 4.5% by mass of the strontium titanate fine powder is externally added, showing poor levels. This is because the strontium titanate fine powder is transferred on the surface of the photosensitive member 1 when a large amount of the strontium titanate fine powder is externally added to increase the amount of the strontium titanate fine powder accumulated at the contact portion where the cleaning device 14 makes a contact with the photosensitive member 1, forming nuclei to trigger filming in which toner is adhered to the nuclei along the upward direction at the periphery of the photosensitive member 1. Since the strontium titanate fine powder has an inverse polarity to the negatively charged toner particles, the powder is transferred to the blank of the image on the photosensitive member 1 during development. While almost the entire part of the silica fine powder as inorganic fine powder A is transferred to the transcription member together with the toner particles during development since the silica fine powder as inorganic fine powder A has the same polarity as the toner particles, most of the strontium titanate fine powder remains on the photosensitive member 1 without being developed and arrives at the contact portion between the cleaning device 14 and photosensitive member 1, because strontium titanate fine powder has an inverse polarity to the negatively charged toner. In other words, nuclei on the photosensitive member 1 that cause filming is more liable to be generated by the strontium titanate fine powder than the silica fine powder as inorganic fine powder A.

In summary, filming can be effectively prevented in the experiment (5) when zero to 4.0% by mass of the strontium titanate fine powder is externally added.

Filming does not appear at all in the experiment (6) when the strontium titanate fine powder is externally added in the range of zero to 4.0% by mass, showing a good level.

Slight filming appears at 9,615 sheets and 9,213 sheets in the continuous durability tests when 4.1% by mass and 4.5% by mass of the strontium titanate fine powders are externally added, respectively, showing good levels. This is because the amount of the strontium titanate fine powder accumulated at the contact portion between the cleaning device 14 and photosensitive member 1 is increased when a large amount of the strontium titanate fine powder is externally added to transfer it on the surface of the photosensitive member 1. The accumulated strontium titanate fine powder serves as nuclei to generate filming in which toner is adhered to the nuclei along the upward direction at the periphery of the photosensitive member 1. Filming is less liable to be generated in the experiment (6) than in the experiment (5) because a large amount of the inorganic fine powder A is externally added in the experiment (6). The amount of external additives buried into the photosensitive member 1 is reduced because a large amount of the lubricant is contained in the inorganic fine powder A, thereby nuclei that accelerate can be hardly formed.

The strontium titanate fine powder is transferred on the surface of the photosensitive member 1 when a lot of the strontium titanate fine powder is externally added in the toner as in the experiment (6). Then, a large amount of the strontium titanate fine powder accumulates at the contact portion between the cleaning device 14 and photosensitive member 1, forming nuclei to generate filming in which the toner is adhered to the nuclei along the upward direction at the periphery of the photosensitive member 1. Accordingly, filming is effectively prevented when the strontium titanate fine powder is externally added in any amount in the range of zero to 4.5% by mass.

The experiments (5) and (6) show that filming is effectively prevented by adding zero to 4.0% by mass of the strontium titanate fine powder, when the amount of external addition of the inorganic fine powder A is considered.

No tailing appears in the experiment (7) when 0.5% by mass or more of the strontium titanate fine powder is externally added, showing a good level without any problem. This is because the electrostatic charge on the toner 8 is stabilized by externally adding the strontium titanate fine powder to the toner 8, stabilizing the adhesive force among The toner particles to prevent collapse of the toner transferred on the transcription member.

Slight tailing appears when 0.1% by mass of the strontium titanate is externally added, showing a normal level.

Tailing appears when no strontium titanate is externally added, showing a poor level. This is because the electrostatic charge on the toner is insufficient for stabilizing the adhesive force among the toner particles when no strontium titanate is externally added to the toner 8, causing a collapse of the toner transferred on the transcription material.

No tailing appears in the experiment (8) when 0.5% by mass of the strontium titanate fine powder is externally added, showing a good level without any problem. This is because the electrostatic charge on the toner is stabilized by adding the strontium titanate fine powder to the toner 8, stabilizing the adhesive force among the toner particles to prevent collapse of the toner transferred to the transcription member.

Slight tailing appears when 0.1% by mass of the strontium titanate fine powder is externally added, showing a normal level.

Tailing becomes evident when no strontium titanate fine powder is externally added, showing a poor level. This is because the electrostatic charge on the toner is insufficient for stabilizing the adhesive force among the toner particles when the strontium titanate fine powder is not externally added to the toner 8, causing collapse of the toner transferred on the transcription member.

Tailing is effectively prevented in the experiment (7) and (8) when 0.1 to 4.0% by mass of the strontium titanate fine powder is externally added. Tailing was independent of the amount of external addition of the inorganic fine powder A.

Accordingly, prevention of filming and tailing is satisfied in the continuous durability test when 0.1 to 4.0% by mass of the strontium titanate fine powder is externally added.

Experiments in TABLE 10 and TABLE 11 will be then described in detail.

TABLE 10: Image defects and creep-out were confirmed by the continuous durability tests in the H/H environment and L/L environment, respectively, with an image printing ratio of 4%, wherein 0.1% by mass of the strontium titanate fine particle and 2.0% by mass of the inorganic fine particle A were added while changing the number average particle size of the strontium titanate fine particle to 1: 0.005 μm, 2: 0.01 μm, 3: 3.0 μm and 4: 3.5 μm. The photosensitive member (B) that has been used in TABLE 9 was also used in TABLE 10.

TABLE 11: Image defects and creep-out were confirmed by the continuous durability tests in the H/H environment and L/L environment, respectively, with an image printing ratio of 4%, wherein 4% by mass of the strontium titanate fine particle and 2.0% by mass of the inorganic fine particle A were externally added while changing the number average particle size of the strontium titanate fine particle to 1: 0.005 μm, 2: 0.01 μm,3: 3.0 μm and 4: 3.5 μm. The photosensitive member (B) that has been used in TABLE 9 was also used in TABLE 11.

TABLE 10

The relation between the number average particle size of the strontium titanate fine powder, and image defects and creep-out when 0.1% by mass of strontium titanate fine powder and 2.0% by mass of the inorganic fine powder A are externally added

| NUMBER AVERAGE PARTICLE SIZE OF STRONTIUM TITANATE FINE POWDER (μm) | 1<br>0.005 | 2<br>0.01 | 3<br>3.0 | 4<br>3.5 |
|---|---|---|---|---|
| IMAGE DEFECTS | (9226)<br>B | (9285)<br>B | (9183)<br>B | (5888)<br>C |
| CREEP-OUT | C | A | A | A |

TABLE 11

The relation between the number average particle size of the strontium titanate fine powder, and image defects and creep-out when 4% by mass of strontium titanate fine powder and 2.0% by mass of the inorganic fine powder A are added

| NUMBER AVERAGE PARTICLE SIZE OF STRONTIUM TITANATE FINE POWDER (μm) | 1<br>0.005 | 2<br>0.01 | 3<br>3.0 | 4<br>3.5 |
|---|---|---|---|---|
| IMAGE DEFECTS | A | A | A | (6866)<br>C |
| CREEP-OUT | C | A | A | A |

The results in TABLE 10 and TABLE 11 will be described in detail hereinafter.

TABLE 10 shows the experimental results when up to 10,000 sheets in the continuous durability tests were carried out using the toners in which respective strontium titanate fine powders, whose number average particle sizes were divided into three ranges, were externally added in an amount of 0.1% by mass. The strontium titanate fine powder was externally added in a proportion of 0.1% by mass while the inorganic fine powder A was externally added in a proportion of 2.0% by mass in the experiments in TABLE 10, since creep-out is independent of the amount of external addition of the inorganic fine powder A while an increased amount of external addition of the inorganic fine powder A is disadvantageous for image defects.

The letters A, B and C in the table denote a good level without any problem, a normal level and a poor level, respectively. The numerals in the parenthesis denote the number of sheets when image defects or "creep-out" has appeared in the continuous durability test.

TABLE 10 shows that image defects are at the normal levels in the experiments 1, 2 and 3. Image defects appear at 5,882 sheets in the continuous durability tests, indicating a poor level. This is because the lubricant in the inorganic fine powder A is expanded on the surface of the photosensitive member 1 since a little amount of the strontium titanate is externally added but a lot of the inorganic fine powder is externally added in the experiments in TABLE 10, thereby reducing the degree of polishing on the surface of the photosensitive member 1 to generate slight image defects. However, the surface of the photosensitive member 1 can be uniformly scraped until the latter half stage of the durability test because the strontium titanate fine powder has a small number average particle size in the experiments 1, 2 and 3, allowing image defects to be prevented until the latter half stage of the durability test.

The surface of the photosensitive member 1 can not be uniformly scraped because the strontium titanate fine powder has a larger number average particle size in the experiment 4 than in the experiments 1, 2 and 3, forming irregularly scraped portions to generate image defects at the portions where not scraped.

Creep-out is in good levels in the experiments 2, 3 and 4.

Creep-out appears at the initial stage of the durability tests in the experiment 1, because a lot of the strontium titanate fine powder having a small number average particle size creeps out of the contact gap between the cleaning device 14 and photosensitive member 1 in the experiment 1, although a little amount of the strontium titanate fine powder having a large number average particle size creeps out of the contact gap between the cleaning device 14 and photosensitive member 1 in the experiments 2, 3 and 4.

TABLE 11 shows the experimental results when up to 10,000 sheets in the continuous durability tests were carried out using the toners in which respective strontium titanate fine powders, whose number average particle sizes were divided into three ranges, were externally added in an amount of 4% by mass. The inorganic fine powder A was externally added in a proportion of 2.0% by mass in the experiments in TABLE 11 as in the experiments in TABLE 10, since creep-out is independent of the amount of external addition of the inorganic fine powder A while an increased amount of external addition of the inorganic fine powder A is disadvantageous for image defects.

The letters A, B and C in the table denote a good level without any problem, a normal level and a poor level, respectively. The numerals in the parenthesis denote the number of sheets when image defects or "creep-out" has appeared in the continuous durability test.

The results of the experiments 1, 2 and 3 are at good levels with respect to image defects. Image defects appear at 6,866 sheets in the continuous durability test in the experiment 4, showing a poor level. This is because the lubricant in the inorganic fine powder A is expanded on the surface of the photosensitive member 1 because a little amount of the strontium titanate fine powder is externally added but a lot of the inorganic fine powder A is externally added in the experiments in TABLE 11, thereby diminishing the degree of polishing on the surface of the photosensitive member 1. In addition, the surface of the photosensitive member 1 cannot be sufficiently scraped since the number average particle size of the strontium titanate fine powder is larger in the experiment A than in the experiments 1, 2 and 3, causing irregular scrapes to consequently generate image defects at the non-scraped portions. However, the polishing effect is larger due to an increased amount of external addition of the strontium titanate fine powder in the experiment in TABLE 11 than in the experiments in TABLE 10, thereby retarding generation of image defects.

The results in-the experiments 2, 3 and 4 are in good levels with respect to creep-out.

Creep-out appears at the initial stage of the durability test, because a lot of the strontium titanate fine powder having a small number average particle size creeps out of the contact gap between the cleaning device 14 and photosensitive member 1 in the experiment 1, although a little amount of the strontium titanate fine powder having a large number average particle size creeps out of the contact gap between the cleaning device 14 and photosensitive member 1 in the experiments 2, 3 and 4.

The experimental results in TABLE 10 and TABLE 11 show that prevention of image defects and creep-out are satisfactory when the strontium titanate fine powder has a number average particle size of 0.01 μm and 3 μm, when the amount of external addition of the inorganic fine powder A is considered.

The experiments in TABLE 12 will be then described in detail.

Image defects and fusion of the toner were confirmed by changing the amount of the inorganic fine powder A to the toner, wherein image defects were confirmed in the continuous durability test in the H/H environment (image printing ratio 4%) in the experiments (1) and (2), while fusion of the toner was confirmed in the continuous durability test in the H/H environment (image printing ratio 4%) in the experiments (3) and (4).

(1) The surface layer of the photosensitive member comprises a blend of the polycarbonate resin (I) and polycarbonate resin (II). The strontium titanate fine powder was externally added in a proportion of 0.1% by mass to the toner.

(2) The surface layer of the photosensitive member comprises a blend of the polycarbonate resin (I) and polycarbonate resin (II). The strontium titanate fine powder was externally added in a proportion of 4% by mass to the toner.

(3) The surface layer of the photosensitive member comprises a blend of the polycarbonate resin (I) and polycarbonate resin (II). The strontium titanate fine powder was externally added in a proportion of 0.1% by mass to the toner.

(4) The surface layer of the photosensitive member comprises a blend of the polycarbonate resin (I) and polycarbonate resin (II). The strontium titanate fine powder was externally added in a proportion of 4% by mass to the toner.

TABLE 12

The relation between the amount of external addition of the inorganic fine powder A, and image defects and fusion of the toner

| | PHOTOSENSITIVE MEMBER* | INORGANIC FINE POWDER A (% BY MASS) → STRONTIUM TITANATE FINE POWDER (% BY MASS) ↓ | 0 | 0.01 | 0.02 | 0.05 | 0.1 | 0.5 | 1.0 | 1.5 | 2.0 | 2.01 |
|---|---|---|---|---|---|---|---|---|---|---|---|---|
| (1) IMAGE DEFECTS | PHOTOSENSITIVE MATERIAL (B) | 0.1 | A | A | A | A | A | A | A | A | B | C |
| (2) IMAGE DEFECTS | PHOTOSENSITIVE MATERIAL (B) | 4.0 | A | A | A | A | A | A | A | A | A | A |
| (3) FUSION OF TONER | PHOTOSENSITIVE MATERIAL (B) | 0.1 | C | C | B | A | A | A | A | A | A | A |
| (4) FUSION OF TONER | PHOTOSENSITIVE MATERIAL (B) | 4.0 | C | C | B | B | A | A | A | A | A | A |
| (5) VERTICAL STRIPES ON THE IMAGE | PHOTOSENSITIVE MATERIAL (B) | 0.1 | C | C | B | A | A | A | A | A | A | A |
| (6) VERTICAL STRIPES ON THE IMAGE | PHOTOSENSITIVE MATERIAL (B) | 4.0 | C | C | B | B | A | A | A | A | A | A |

The photosensitive member (B) is the same as the photosensitive member (B) used in TABLE 9.

The results in TABLE 12 will be described in detail.

TABLE 12 shows the experimental results of up to 10,000 sheets in the durability test in the H/H environment when the amounts of external addition of the inorganic fine powder A were changed in the range of zero to 2.01% by mass while externally adding 0.1 and 4.0% by mass of the strontium titanate. The letters A, B and C denote a good level, a normal level and a poor level, respectively.

Image defects do not appear at all when the inorganic fine powder A in the range of zero to 1.5% by mass was externally added in the experiment (1), showing a good level. This is because the strontium titanate fine powder can uniformly scrape the surface of the photosensitive member 1 without being affected by the inorganic fine powder A expended with the cleaning device, consequently preventing image defects from be generated.

Slight image defects appear at 9,776 sheets in the continuous durability test when 2.0% by mass of the inorganic fine powder A is externally added, showing a normal revel. This is because the inorganic fine powder A that is expanded with the cleaning device inhibits the function of the strontium titanate fine powder for polishing the surface of the photosensitive member 1, causing image defects at the latter half stage of the durability test.

Image defects appear at 4,327 sheets in the continuous durability test when 2.01% by mass of the inorganic fine powder A is externally added, showing a poor level. This is because a large amount of external addition of the inorganic fine powder A that is expanded with the cleaning device inhibits the function of the strontium titanate fine powder for polishing the surface of the photosensitive member 1, generating image defects.

In summary, image defects are effectively prevented in the experiment (1) when zero to 2% by mass of the inorganic fine powder A is externally added.

The experiment (2) gives a good level in any amount of external addition of the inorganic fine powder A in the range of zero to 2.01% by mass. This is because the surface of the photosensitive member 1 is uniformly scraped without being affected by the amount of external addition of the inorganic fine powder A because a lot of the strontium titanate fine powder is externally added, enabling generation of image defects to be prevented.

The results in the experiments (1) and (2) show that image defects are effectively prevented by externally adding zero to 2.0% by mass of the inorganic fine powder A.

Fusion of the toner does not appear in the experiment (3) when 0.05 to 2.01% by mass of the inorganic fine powder A is externally added, showing good levels. This is because the lubricant in the inorganic fine powder A that is expanded with the cleaning device can fill-up minute irregular scrapes formed deep on the surface of the photosensitive member 1, thereby preventing nuclei that trigger fusion of the toner from being generated, or preventing fusion of the toner.

Fusion of the toner appears at 9,500 sheets in the continuous durability test when 0.02% by mass of the inorganic fine powder A is externally added, showing a normal level. This is because minute and irregular scrapes formed deep on the surface of the photosensitive member 1 can not be completely filled up since only a little amount of the lubricant in the inorganic fine powder A is expended with the cleaning device, generating nuclei that trigger fusion of the toner at the latter half stage of the durability test to consequently cause fusion of the toner.

Fusion of the toner is caused at 5,300 and 6,500 sheets in the continuous durability tests when zero and 0.01% by mass of the inorganic fine powder A is externally added, showing a poor level. This is because the toner and additives accumulate at the minute and irregular scrape portions to form nuclei since there is no, or little amount of the lubricant in the inorganic fine powder to be expanded with the cleaning device.

Fusion of the toner is effectively prevented in the experiment (3) when the inorganic fine powder A is externally added in a proportion in the range of 0.02 to 2.01% by mass.

Fusion of the toner does not appear at all in the experiment (4) when 0.1 to 2.01% by mass of the inorganic fine powder A is externally added, showing a good level. This is because the lubricant in the inorganic fine powder A that is expanded with the cleaning device can fill up very minute and irregular scrapes formed deep on the photosensitive member 1, thereby preventing nuclei that trigger fusion of the toner from being generated, or preventing generation of fusion. Although a larger amount of the strontium titanate is externally added in the experiment (4) than in the experiment (3), fusion of the toner is never generated so long as the amount of external addition of the inorganic fine powder A is in the range of 0.1 to 2.01% by mass.

Fusion of the toner appears at 9,400 and 9,800 sheets in the continuous durability tests when 0.02% and 0.05% by mass of the inorganic fine powder A are externally added, showing normal levels. This is because a small amount of the lubricant in the inorganic fine powder A that is expanded with the cleaning device cannot fill up very minute and irregular scrapes formed deep on the photosensitive member 1, thereby forming nuclei that trigger fusion of the toner, or consequently causing slight fusion of the toner.

Fusion of the toner appears at 4,200 sheets and 5,100 sheets in the continuous durability test when zero and 0.01% by mass, respectively, of the inorganic fine powders are externally added, showing poor levels. This is because the toner and external additives accumulate at the minute and irregular scrape portions to form nuclei since there is no, or little amount of the lubricant in the inorganic fine powder to be expanded with the cleaning device. Fusion of the toner is effectively prevented when 0.02 to 2.01% by mass of the inorganic fine powder A is externally added in the experiment (4).

The results in the experiment (3) and (4) show that fusion of the toner can be prevented by externally adding 0.02 to 2.01% by mass of the inorganic fine powder A, when the amount of external addition of the strontium titanate is considered.

Experiment 5 shows that vertical stripes on images do not occur when 0.05 to 2.01% by weight of the inorganic fine powder A is added, and 0.02% by weight of strontium titanate fine powder is added, indicating a good level. Experiment 5 also shows that vertical stripes on images begin to appear when 0.02% or 2.01% by weight of the inorganic fine powder A is added and 0.1% by weight of strontium titanate fine powder is added, indicating a normal level. Experiment 5 further shows that vertical stripes on images become prevalent when 0 to 0.01% by weight of the inorganic fine powder A is added and 0.1% by weight of strontium titanate fine powder is added, indicating a poor level. Experiment 6 shows that vertical stripes on images do not occur when 0.1 to 2.01% by weight of the inorganic fine powder A is added, and 4.0% by weight of strontium titanate fine powder is added, indicating a good level. Experiment 6 also shows that vertical stripes on images begin to appear when 0.02% to 0.5% and 2.0% to 2.01% by weight of the inorganic fine powder A is added and 4.0% by weight of strontium titanate fine powder is added, indicating a normal level. Experiment 6 further shows that vertical stripes on images become prevalent when 0 to 0.001% by weight of the inorganic fine powder A is added and 4.0% by weight of strontium titanate fine powder is added, indicating a poor level.

It can be concluded from the experimental results in TABLE 12 that an amount of external addition of the inorganic fine powder A of 0.02 to 2.0 by mass is sufficient for preventing image defects and fusion of the toner, when the amount of external addition of the strontium titanate fine powder is considered.

The results in TABLE 9 to TABLE 12 indicate that all of prevention of image defects and "creep-out", filming and fusion of the toner become satisfactory in the continuous durability test when 0.1 to 4.0% by mass of the strontium titanate fine powder with a number average particle size of 0.01 μm or 3 μm is externally added while externally adding the inorganic fine powder A in the range of 0.02 to 2.05 by mass.

When the surface of the photosensitive member 1 has an appropriate wearing property while externally adding 0.1% to 5.0% by mass, preferably 0.1 to 4.0% by mass, of the strontium titanate fine powder having a particle size of 0.005 to 3.00 μm, preferably 0.01 to 3 μm, and keeping the amount of external addition of the inorganic fine powder A to 0.02 to 2.0% by mass, image defects can be completely prevented from occurring. In addition, filming, prevention of fusion of the toner and creep-out become satisfactory to enable a high quality image to be obtained.

Although the strontium titanate fine powder was used in the present invention, the powder is not limited thereto but, for example, cerium oxide fine powder and magnesium oxide fine powder may be used.

While the second inorganic fine powder having a number average particle size of 8 μm is used, and the lubricant contains 40% by mass of silicon oil comprising dimethyl silicon oil having a viscosity of 0.0125 $m^2/s$ (12,500 cSt) in the present embodiment, they are not limited thereto but other external additives may be used so long as they have the same effect as hitherto described.

The second inorganic fine powder may contain the lubricant in the range of 25 to 90% by mass, preferably in the range of 30 to 90% by mass, and more preferably in the range of 40 to 65% by mass based on the mass of the inorganic fine powder, and the number average particle size is in the range of 0.5 to 50 μm, preferably in the range of 3 to 20 μm.

Fourth Embodiment

The photosensitive member described in the first embodiment is used, wherein a mixture of the resin fine particle, silica fine powder subjected to hydrophobic treatment (referred as hydrophobic silica hereinafter) and strontium titanate fine powder was used as the first fine powder, and the inorganic fine powder A as used in the first embodiment was used as the second fine powder.

Drawings and a description of the apparatus, and a description of the photosensitive member 1 are omitted herein since they are the same as described in the first embodiment.

Adding a mixture of the resin fine powder, hydrophobic silica fine powder, and strontium titanate fine powder to the toner as the first fine powder allows the surface of the photosensitive member to be uniformly scraped to remove ozone products formed on the photosensitive member in the present embodiment, thereby suppressing image defects. In addition, externally adding the inorganic fine powder A containing a specified quantity of a lubricant as the second inorganic fine powder allows the lubricant to be buried into irregular scrapes, thereby preventing the toner and external additives from accumulating on the surface of the photosensitive member to exclude generation of nuclei that trigger fusion of the toner and to suppress fusion of the toner. The process described above also has the following effects (a) to (c).

(a) The toner is sufficiently charged since the mixture added as the first fine powder contains the hydrophobic silica fine powder, favoring development and transcription to enhance the solid density.

(b) The mixture to be added to the toner as the first fine powder contains the strontium titanate fine powder. Consequently, the electrostatic charge on the toner is stabilized to stabilize the adhesive force among the toner particles, thereby preventing the toner transferred on the transcription member from collapsing to suppress tailing of the image.

(c) The mixture to be added to the toner as the first fine powder contains the resin fine powder as well as the hydrophobic silica fine powder and strontium titanate fine powder. The resin fine powder serves to suppress flaws on the surface of the photosensitive member from being generated, because the resin fine powder creeping out of the cleaning blade is adsorbed on the contact electrostatic charge interruptive member, and the resin fine powder adsorbed on the contact electrostatic charge interruptive member adsorbs the hydrophobic silica fine powder and strontium titanate fine powder also creeping out of the cleaning device. Accordingly, fusion of the toner can be suppressed up to the large number of sheets of the durability test.

The resin fine particle to be added to the toner as the first fine powder in the present embodiment may have a number average particle size of 0.005 to 3.00 μm, preferably 0.01 to 3.00 μm. Examples of the resin fine powder include the melamine-formaldehyde fine powder used in the first embodiment, or the resins polymerized using the following polymerizable monomers.

The polymerizable monomers include: styrene monomers such as styrene, o-methylstyrene, m-methylstyrene and p-methylstyrene, p-metoxystyrene and p-ethyl styrene; acrylic acid; methacrylic acid; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylonitrile; methacrylonitrile; and acrylamide.

While suspension polymerization, emulsion polymerization and leap-free polymerization may be used, resin fine powders obtained by the soap-free polymerization is preferable.

In the present embodiment, the hydrophobic silica fine powder with a number average particle size of 0.005 to 3.00 μm used in the second embodiment as the first fine powder can be also used as the hydrophobic silica fine powder to be used in the mixture to be added to the toner-as the first fine powder.

In the present embodiment, the strontium titanate fine powder with a number average particle size of 0.005 to 3.00 μm used in the third embodiment as the first fine powder can be also used as the strontium titanate fine powder to be used in the mixture to be added to the toner as the first fine powder.

It is necessary for exhibiting the effect as hitherto described that the toner contains a mixture of the resin fine powder, hydrophobic silica fine powder, and strontium titanate fine powder in a proportion in the range of 0.1 to 5.0% by mass, preferably 0.8 to 4.0% by mass, as the first fine powder in the present embodiment.

The mixing mass ratio among the resin fine powder, the hydrophobic silica fine powder, and the strontium titanate fine powder in the mixture as the first fine powder is in the range of 1:5 to 150:2 to 150, preferably in the range of 1:5 to 50:2 to 50.

Examples of the experiments carried out in the present embodiment will be described below.

The toner having the following construction was used instead of the toner 8 used in the experimental examples in the first embodiment. Up to 10,000 sheets in the continuous durability tests were carried out using the image forming apparatus shown in FIG. 1 used in the experimental examples in the first embodiment.

Image defects and fusion of the toner evaluated in the examples in the first to third embodiment, creep-out evaluated in the examples in the first embodiment, the solid density and fixing ability evaluated in the examples in the second embodiment, and filming and tailing evaluated in the examples in the third embodiment were also evaluated using the same evaluation standards as used in the examples in the first to third embodiments.

The same contact pressures of 0.29N (30 gf) between photosensitive member 1 and the cleaning blade, and 9.81N (1000 gf) between the photosensitive member 1 and the electrostatic charging roller as used in the first embodiment were also used in the present embodiment.

The toner having a desired particle size distribution was prepared by melting and kneading a mixture of a binding resin, a magnetic substance, a charge control agent and wax with a biaxial extruded heated at 130° C.,; coarsely crushing the kneaded mixture after cooling, finely pulverizing the coarse particles with a jet mill, and classifying the fine particles with an elbow classifier. The first fine powder was prepared by mixing 0.1% by weight of the acrylic resin with a number average particle size of 0.5 μm, 1.5% by mass of the silica fine powder, treated with an organic silicon compound after treating with a silane coupling reagent, with a number average particle size of 0.05 μm, and 1.0% by mass of the strontium titanate fine powder with a number average particle size of 1.0 μm. The second fine powder was an inorganic fine powder with a number average particle size of 8 μm in which 40% by mass of silicone oil as a lubricant was mixed with $SiO_2$. A mixture, prepared by adding and mixing 2.6% by mass of the first fine powder and 0.1% by mass of the second fine powder to the toner with a Henshel mixer, was used in the present embodiment.

The photosensitive member (B) used in the first embodiment was also used as the photosensitive member 1 in the present embodiment.

Image defects, fusion of the toner, creep-out, solid density, fixing ability, filming and tailing up to 10,000 sheets in the continuous durability tests were all at A-levels without any problems, indicating that the effects in the first to third embodiments are also expressed in their combination in the present embodiment.

Fifth Embodiment

The fifth embodiment according to the present invention will be described referring to FIG. 3.

Figure 3:
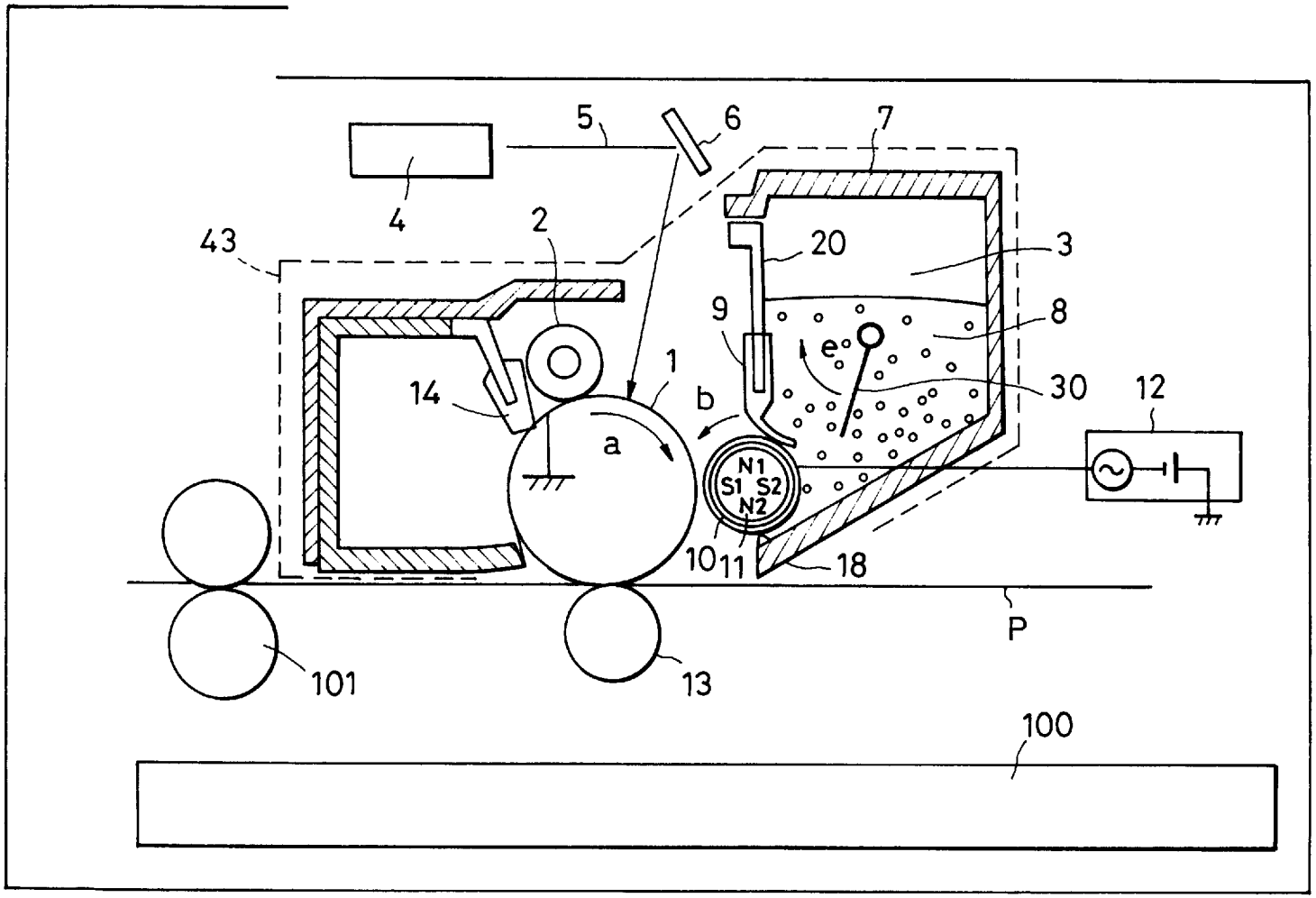
FIG. 3 shows a cross section of an illustrative construction of the process cartridge according to the present invention.

According to the present embodiment, the process apparatus comprises photosensitive member 1, electrostatic charging roller 2, development machine 7, toner 8 and cleaning device 14 described in the first embodiment, which are integrated to construct a process cartridge 43 freely attachable to and detachable from the main unit of the image forming apparatus as shown in FIG. 3. Elements in FIG. 3 identified by the same numbers as in FIG. 1 are the same and a description thereof is omitted.

The image formed in this process cartridge is transferred to a transcription paper P with a transcription device provided at the main unit of the image forming apparatus comprising a power supply for actuating the photosensitive member 1 and a high-voltage circuit for supplying a bias for image formation, and fixed at a fixing machine 101.

The toner left on the photosensitive member 1 without being transferred to the transcription paper P is removed with the cleaning device 14 in the process cartridge 43.

The process described above allows image defects and fusion of the toner to be completely prevented as described in the examples in the first embodiment, making it possible to obtain an excellent and high-quality image that satisfactorily prevents creep-out, along with providing a process cartridge being free from any maintenance.

Sixth Embodiment

The examples in the sixth embodiment will be described hereinafter.

According to the present embodiment, the process apparatus comprises photosensitive member 1, electrostatic charging roller 2, development machine 7, toner 8 and cleaning device 14 described in the second embodiment, which are integrated to construct a freely attachable and detachable process cartridge 43 to the main unit of the image forming apparatus. A description of the drawing and construction of the apparatus are omitted since they are the same as described in the fifth embodiment.

The construction in the present embodiment allows image defects and fusion of the toner to be completely prevented as described in the examples in the second embodiment, making it possible to obtain an excellent and high-quality image that satisfactorily prevents creep-out, along with providing a process cartridge being free from any maintenance.

Seventh Embodiment

The examples in the seventh embodiment will be described hereinafter.

According to the present embodiment, the process apparatus comprises photosensitive member 1, electrostatic charging roller 2, development machine 7, toner 8 and cleaning device 14 described in the third embodiment, which are integrated to construct a freely attachable and detachable process cartridge 43 to the main unit of the image forming apparatus. A description of the drawing and the construction of the apparatus are omitted since they are the same as described in the fifth embodiment.

The construction in the present embodiment allows image defects and fusion of the toner to be completely prevented as described in the examples in the third embodiment, making it possible to obtain an excellent and high-quality image that satisfactorily prevents creep-out, along with providing a process cartridge being free from any maintenance.

Eighth Embodiment

The examples in the eighth embodiment will be described hereinafter.

According to the present embodiment, the process apparatus comprises photosensitive member 1, electrostatic charging roller 2, development machine 7, toner 8 and cleaning device 14 described in the fourth embodiment, which are integrated to construct a freely attachable and detachable process cartridge 43 to the main unit of the image forming apparatus. A description of the drawing and the construction of the apparatus are omitted since they are the same as described in the fifth embodiment.

The construction in the present embodiment allows image defects and fusion of the toner to be completely prevented as described in the examples in the fourth embodiment, making it possible to obtain an excellent and high-quality image that satisfactorily prevents creep-out, along with providing a process cartridge being free from any maintenance.

According to the present invention as hitherto described, forming a stable and high quality image is made possible by suppressing the drawbacks of image defects and fusion of the toner by improving the photosensitive layer of the image carrying member and additives, and an appropriate selection of the additives in the developer not only improves image density but also effectively suppresses filming and tailing.

What is claimed is:

1. An image forming apparatus comprising:

an image carrying member for carrying an electrostatic latent image, said image carrying member having a photosensitive layer on a conductive substrate;

a developer for developing the electrostatic latent image carried on the image carrying member;

a developer carrying member for carrying the developer and conveying it to a development area;

a control member making contact with the developer carrying member for controlling the coating amount of the developer; and a cleaning member for cleaning the surface of the photosensitive layer of said image carrying member by making contact with the surface of the photosensitive layer of the image carrying member with a contact pressure of 0.15N (15 gf) to 0.89N (90 gf), wherein the photosensitive layer contains at least one kind of polycarbonate resins (I) having a viscosity average molecular weight of $1.5\times10^4$ or less and at least one kind of polycarbonate resins (II) having a viscosity average molecular weight of more than $1.5\times10^4$, the polycarbonate resin (I) is contained in 30% by mass to 95% by mass based on the total content of the resins (I) and (II), wherein the developer has a toner containing toner particles and external additives, and wherein the toner contains (a) 0.1% by mass to 5.0% by mass of a first fine powder with a number average particle size of 0.005 $\mu$m to 3.00 $\mu$m, and (b) 0.02% by mass to 2.00% by mass of an inorganic second fine powder containing 25% by mass to 90% by mass of a lubricant, as external additives.

2. An image forming apparatus according to claim 1, wherein the toner contains 0.1% by mass to 5.0% by mass of a resin powder with a number average particle size of 0.005 $\mu$m to 3.00 $\mu$m as the first fine powder.

3. An image forming apparatus according to claim 1, wherein the toner contains 0.8% by mass to 2.0% by mass of a silica fine powder, alumina fine powder, or titanium fine powder with a number average particle size of 0.005 $\mu$m to 2.50 $\mu$m as the first fine powder.

4. An image forming apparatus according to claim 1, wherein the toner contains 0.1% by mass to 4.0% by mass of a fine powder of strontium titanate, cerium oxide, or magnesium oxide with a number average particle size of 0.01 $\mu$m to 3.00 $\mu$m as the first fine powder.

5. An image forming apparatus according to claim 1, wherein the toner contains 0.1% by mass to 5.0% by mass of a mixture as the first fine powder, comprising a resin fine powder with a number average particle size of 0.01 $\mu$m to 3.00 $\mu$m, a silica fine powder subjected to a hydrophobic treatment with a number average particle size of 0.01 $\mu$m to 3.00 $\mu$m, and a fine powder of strontium titanate with a number average particle size of 0.01 $\mu$m to 3.00 $\mu$m.

6. An image forming apparatus according to claim 5, wherein the mass ratio of the contents among the resin fine powder denoted by R, silica powder subjected to a hydrophobic treatment denoted by C, and fine powder of strontium titanate denoted by T in the mixture satisfies the following relation:

$$R:C:T=1:5 \text{ to } 150:2 \text{ to } 150.$$

7. An image forming apparatus according to claim 1, wherein the inorganic second fine powder has a number average particle size of 0.5 $\mu$m to 50 $\mu$m.

8. An image forming apparatus according to claim 1, wherein lubricant contained in the second inorganic fine powder is silicon oil.

9. An image forming apparatus according to claim 1, wherein the inorganic second fine powder contains 30% by mass to 90% by mass of silicon oil as the lubricant.

10. An image forming apparatus according to claim 1, wherein the inorganic second fine powder contains 40% by mass to 65% by mass of silicon oil as the lubricant.

11. An image forming apparatus according to claim 1, further comprising an electrostatic charging member for primary electrostatic charging of the photosensitive layer by contacting the surface of the photosensitive layer with a contact pressure of 1.96N (200 gf) to 29.42N (3000 gf).

12. An image forming apparatus according to claim 11, wherein the electrostatic charging member comprises a roller applied with an electrostatic charging bias voltage.

13. An image forming apparatus according to claim 12, wherein the electrostatic charging bias voltage contains a direct current component and an alternating current component.

14. An image forming apparatus according to claim 1, wherein the coating amount of the developer on the developer carrying member is controlled so that the thickness of the developer layer becomes thinner than the minimum gap between the image carrying member and developer carrying member.

15. An image forming apparatus according to claim 14, wherein the developer carrying member is applied with a development bias voltage that is a superposition of a direct current bias and an alternating current bias during development.

16. A process cartridge detachably mountable to a main unit of an image forming apparatus, comprising:

an image carrying member for carrying an electrostatic latent image, said image carrying member having a photosensitive layer on a conductive substrate;

a developer for developing the electrostatic latent image carried on the image carrying member;

a developer carrying member for carrying the developer to convey it to a development area;

a controlling member for controlling the coating amount of the developer by making contact with the developer carrying member;

a cleaning member for cleaning the surface of the photosensitive layer of said image carrying member by making contact with the surface of the photosensitive layer of the image carrying member with a contact pressure of 0.15N (15 gf) to 0.89N (90 gf); and a cartridge container for integrating the image carrying member, the developer, the developer carrying member, the control member and the cleaning member into one unit, wherein the photosensitive layer contains at least one kind of polycarbonate resins (I) having a viscosity average molecular weight of $1.5\times10^4$ or less and at least one kind of polycarbonate resins (II) having a viscosity average molecular weight of more than $1.5\times10^4$, the polycarbonate resin (I) accounting for 30% by mass to 95% by mass based on the total content of the resins (I) and (II), wherein the developer has a toner containing toner particles and external additives, and wherein the toner contains (a) 0.1% by mass to 5.0% by mass of a first fine powder with a number average particle size of 0.005 μm to 3.00 μm, and (b) 0.02% by mass to 2.00% by mass of an inorganic second fine powder containing 25% by mass to 90% by mass of a lubricant, as external additives.

17. A process cartridge according to claim 16, wherein the toner contains 0.1% by mass to 5.0% by mass of a resin powder with a number average particle size of 0.005 μm to 3.00 μm as the first fine powder.

18. A process cartridge according to claim 16, wherein the toner contains 0.8% by mass to 2.0% by mass of a silica fine powder, an alumina fine powder, or a titanium fine powder with a number average particle size of 0.005 μm to 2.50 μm as the first fine powder.

19. A process cartridge according to claim 16, wherein the toner contains 0.1% by mass to 4.0% by mass of a fine powder of strontium titanate, cerium oxide, or magnesium oxide with a number of average particle size of 0.01 μm to 3.00 μm as the first fine powder.

20. A process cartridge according to claim 16, wherein the toner contains 0.1% by weight to 5.0% by weight of a mixture comprising a resin fine powder with a number average particle size of 0.01 μm to 3.00 μm, a silica fine powder subjected to a hydrophobic treatment with a number average particle size of 0.01 μm to 3.00 μm, and a fine powder of strontium titanate with a number average particle size of 0.01 μm to 3.00 μm as the first fine powder.

21. A process cartridge according to claim 20, wherein the mass ratio of the contents of the resin fine powder denoted by R, the silica fine powder subjected to a hydrophobic treatment denoted by C, and a fine powder of strontium titanate denoted by T satisfies the following relation:

$$R:C:T=1:5 \text{ to } 150:2 \text{ to } 150.$$

22. A process cartridge according to claim 16, wherein the inorganic second fine powder has a number average particle size of 0.5 μm to 50 μm.

23. A process cartridge according to claim 16, wherein lubricant contained in the second inorganic powder is silicon oil.

24. A process cartridge according to claim 16, wherein the inorganic second fine powder contains 30% by mass to 90% by mass of silicon oil as the lubricant.

25. A process cartridge according to claim 16, wherein the inorganic second fine powder contains 40% by mass to 65% by mass of silicon oil as the lubricant.

26. A process cartridge according to claim 16, wherein the image forming apparatus further comprises an electrostatic charging member for primary charging of the photosensitive layer by contacting the surface of the photosensitive layer with a contact pressure of 1.96N (200 gf) to 29.4N (3000 gf).

27. A process cartridge according to claim 26, wherein the electrostatic charging member comprises a roller applied with an electrostatic charging bias voltage.

28. A process cartridge according to claim 27, wherein the electrostatic charging bias voltage comprises a direct current component and an alternating current component.

29. A process cartridge according to claim 16, wherein the amount of coating of the developer on the developer carrying member is controlled so that the thickness of the developer layer becomes thinner than the minimum gap between the image carrying member and developer carrying member.

30. A process cartridge according to claim 16, wherein the developer carrying member is applied with a development bias voltage that is a superposition of a direct current bias and an alternating current bias during development.

* * * * *

UNITED STATES PATENT AND TRADEMARK OFFICE

CERTIFICATE OF CORRECTION

PATENT NO. : 6,175,703 B1
DATED : January 16, 2001
INVENTOR(S) : Yusuke Nakazono, et al.

It is certified that error appears in the above-identified patent and that said Letters Patent is hereby corrected as shown below:

Title page,
Item [57], ABSTRACT,
Line 1, "An" should read -- The present invention provides an --.

Column 20,
Line 26, "is" should be deleted.

Column 21,
Line 42, "creep" should read -- creep- --.

Column 23,
Line 48, "9,66" should read -- 966 --.

Column 42,
Lines 14 and 28, "very" should read -- every --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*